US010794611B2

(12) United States Patent
Suzuki et al.

(10) Patent No.: US 10,794,611 B2
(45) **Date of Patent: *Oct. 6, 2020**

(54) REFRIGERATION CYCLE APPARATUS

(71) Applicant: Mitsubishi Electric Corporation, Tokyo (JP)

(72) Inventors: Yasuhiro Suzuki, Tokyo (JP); Masahiko Takagi, Tokyo (JP); Kenyu Tanaka, Tokyo (JP); Kazuki Watanabe, Tokyo (JP); Naoya Matsunaga, Tokyo (JP); Teppei Higuchi, Tokyo (JP)

(73) Assignee: Mitsubishi Electric Company, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/066,713

(22) PCT Filed: Mar. 10, 2016

(86) PCT No.: PCT/JP2016/057506

§ 371 (c)(1),
(2) Date: Jun. 28, 2018

(87) PCT Pub. No.: WO2017/154161

PCT Pub. Date: Sep. 14, 2017

(65) Prior Publication Data

US 2019/0017722 A1 Jan. 17, 2019

(51) Int. Cl.
*F24F 11/89* (2018.01)
*F24F 11/36* (2018.01)
(Continued)

(52) U.S. Cl.
CPC ..... *F24F 11/89* (2018.01); *F24F 11/36* (2018.01); *F24F 11/65* (2018.01); *F24F 11/72* (2018.01);
(Continued)

(58) Field of Classification Search
None
See application file for complete search history.

(56) References Cited

U.S. PATENT DOCUMENTS

2002/0178738 A1 12/2002 Taira et al.
2006/0191318 A1 * 8/2006 McBride ..... G01N 33/0009 73/23.2

(Continued)

FOREIGN PATENT DOCUMENTS

CN 107250683 A 10/2017
CN 107923642 A 4/2018

(Continued)

OTHER PUBLICATIONS

International Search Report of the International Searching Authority dated May 31, 2016 for the corresponding international application No. PCT/JP2016/057506 (and English translation).

(Continued)

*Primary Examiner* — Kenneth M Lo
*Assistant Examiner* — Istiaque Ahmed
(74) *Attorney, Agent, or Firm* — Posz Law Group, PLC

(57) ABSTRACT

A refrigeration cycle apparatus includes a refrigeration cycle circuit that includes a plurality of load-side heat exchangers and a plurality of indoor units that accommodate the plurality of load-side heat exchangers. Each of the plurality of indoor units includes an air-sending fan. At least one of the plurality of indoor units includes a refrigerant detection unit. When refrigerant is detected by the refrigerant detection unit included in any one of the plurality of indoor units, the air-sending fans included in all of the plurality of indoor units operate.

4 Claims, 12 Drawing Sheets

(51) Int. Cl.

| | |
|---|---|
| ***F24F 11/72*** | (2018.01) |
| ***F24F 11/65*** | (2018.01) |
| ***F25B 1/00*** | (2006.01) |
| ***F25B 13/00*** | (2006.01) |
| ***F25B 49/02*** | (2006.01) |
| *F24F 110/10* | (2018.01) |
| *F25B 9/00* | (2006.01) |
| *F25B 41/06* | (2006.01) |

(52) U.S. Cl.

CPC ..... *F25B 1/00* (2013.01); *F25B 13/00* (2013.01); *F25B 49/02* (2013.01); *F24F 2110/10* (2018.01); *F25B 9/002* (2013.01); *F25B 41/062* (2013.01)

(56) References Cited

U.S. PATENT DOCUMENTS

| | | | | |
|---|---|---|---|---|
| 2017/0350822 | A1* | 12/2017 | Bower | G01N 27/125 |
| 2018/0045424 | A1 | 2/2018 | Yajima et al. | |
| 2018/0283725 | A1* | 10/2018 | Ikawa | F24F 3/14 |

FOREIGN PATENT DOCUMENTS

| | | | |
|---|---|---|---|
| EP | 3 260 791 | A1 | 12/2017 |
| EP | 3 279 590 | A1 | 2/2018 |
| EP | 3 346 203 | A1 | 7/2018 |
| JP | H02-140573 | A | 5/1990 |
| JP | 4599699 | B2 | 4/2002 |
| JP | 2012-013339 | A | 1/2012 |
| JP | 2013-122364 | A | 6/2013 |
| WO | 2016/132906 | A1 | 8/2016 |

OTHER PUBLICATIONS

Office Action dated May 21, 2019 issued in corresponding AU patent application No. 2016397074.

Extended European Search Report dated Feb. 15, 2019 issued in corresponding EP patent application No. 16893491.7.

Office Action dated Dec. 27, 2019 issued in corresponding CN patent application No. 201680082830.0 (and English translation).

* cited by examiner

REFRIGERATION CYCLE APPARATUS

CROSS REFERENCE TO RELATED APPLICATION

This application is a U.S. national stage application of PCT/JP2016/057506 filed on Mar. 10, 2016, the contents of which are incorporated herein by reference.

TECHNICAL FIELD

The present invention relates to a refrigeration cycle apparatus including a plurality of indoor units.

BACKGROUND ART

An air-conditioning apparatus is described in Patent Literature 1. The air-conditioning apparatus includes a gas sensor that is provided on an outer surface of an indoor unit and detects refrigerant and a controller that controls an indoor air-sending fan to rotate when the gas sensor detects refrigerant. In the air-conditioning apparatus, when refrigerant leaks into a room through an extension pipe connected to an indoor unit or when refrigerant that has leaked inside an indoor unit passes through a gap in a housing of the indoor unit and flows out to the outside of the indoor unit, the refrigerant that has leaked can be detected by the gas sensor. Furthermore, by causing the indoor air-sending fan to rotate when leakage of refrigerant is detected, indoor air is sucked through an air inlet provided at the housing of the indoor unit, and air is blown into the room through an air outlet. Thus, the refrigerant that has leaked can be diffused.

CITATION LIST

Patent Literature

Patent Literature 1: Japanese Patent No. 4599699

SUMMARY OF INVENTION

Technical Problem

In the air-conditioning apparatus described in Patent Literature 1, when leakage of refrigerant occurs in an indoor unit, an indoor air-sending fan in the indoor unit rotates. Therefore, in a case where a plurality of indoor units are installed in an indoor space having a relatively large floor area, a sufficient air volume for the floor area of the indoor space cannot be obtained with the single indoor air-sending fan, and there is a possibility that the refrigerant that has leaked may not be diffused into the indoor space and diluted. Thus, there is a problem that the density of refrigerant in the indoor space may be locally increased.

The present invention has been designed to solve at least one of the problems described above. An object of the present invention is to provide a refrigeration cycle apparatus that is capable of suppressing a local increase in the density of refrigerant in an indoor space even if refrigerant leaks.

Solution to Problem

A refrigeration cycle apparatus according to an embodiment of the present invention includes a refrigeration cycle circuit that includes a plurality of load-side heat exchangers and a plurality of indoor units that accommodate the plurality of load-side heat exchangers. Each of the plurality of indoor units includes an air-sending fan. At least one of the plurality of indoor units includes a refrigerant detection unit. When refrigerant is detected by the refrigerant detection unit included in any one of the plurality of indoor units, the air-sending fans included in all of the plurality of indoor units operate.

Advantageous Effects of Invention

According to the present invention, even if refrigerant leaks, a local increase in the density of refrigerant in an indoor space can be suppressed.

DESCRIPTION OF EMBODIMENTS

Embodiment 1

Figure 1:
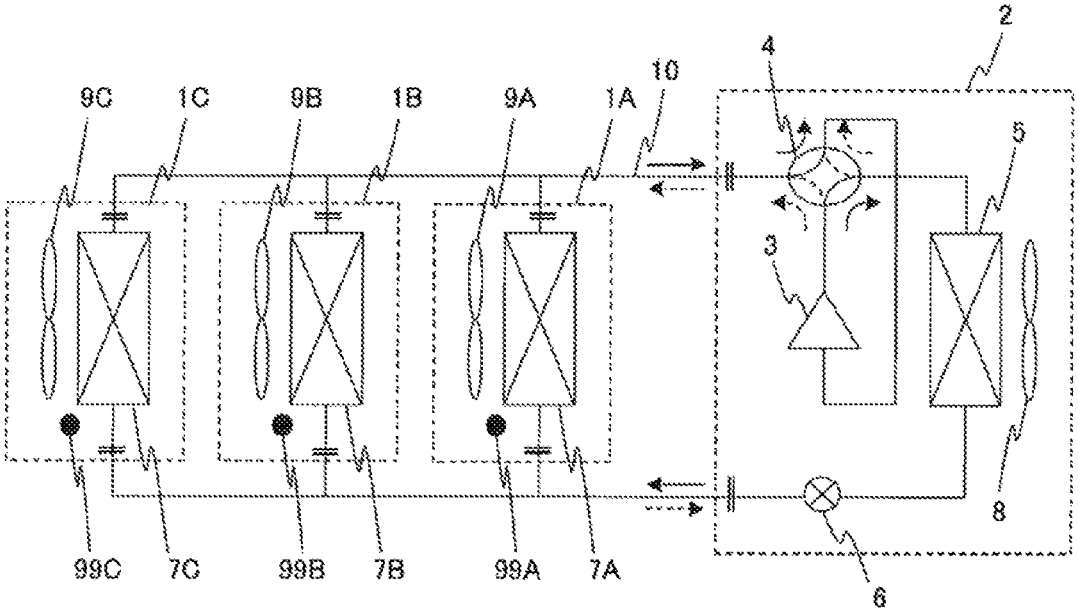
FIG. 1 is a refrigerant circuit diagram illustrating a schematic configuration of an air-conditioning apparatus according to Embodiment 1 of the present invention.

A refrigeration cycle apparatus according to Embodiment 1 of the present invention will be described. In Embodiment 1, an air-conditioning apparatus of a multiple type including a plurality of indoor units is illustrated as an example of a refrigeration cycle apparatus. FIG. 1 is a refrigerant circuit diagram illustrating a schematic configuration of an air-conditioning apparatus according to Embodiment 1. As illustrated in FIG. 1, the air-conditioning apparatus includes a refrigeration cycle circuit 10 that circulates refrigerant. The refrigeration cycle circuit 10 has a configuration in which, for example, a compressor 3, a refrigerant flow switching unit 4, a heat-source-side heat exchanger 5, a pressure-reducing unit 6, and a plurality of load-side heat exchangers 7A, 7B, and 7C are connected by refrigerant pipes in a ring shape. In the refrigeration cycle circuit 10, the load-side heat exchangers 7A, 7B, and 7C are connected in parallel to one another. Furthermore, the air-conditioning apparatus includes, as a heat source unit, for example, an outdoor unit 2 installed outdoors. Furthermore, the air-conditioning apparatus includes, as load units, for example, a plurality of indoor units 1A, 1B, and 1C installed indoors. The outdoor unit 2 is connected to the indoor units 1A, 1B, and 1C by extension pipes, which are part of refrigerant pipes.

As a refrigerant circulating in the refrigeration cycle circuit 10, for example, a slightly flammable refrigerant such as HFO-1234yf or HFO-1234ze or a highly flammable refrigerant such as R290 or R1270 is used. The above-mentioned refrigerant may be used as a single refrigerant or may be used as a mixed refrigerant including two or more types of refrigerant. Hereinafter, a refrigerant having a flammability of a slightly flammable level (for example, 2 L or more according to the classification of ASHRAE 34) may be referred to as a "flammable refrigerant". Furthermore, as a refrigerant circulating in the refrigeration cycle circuit 10, a non-flammable refrigerant such as R22 or R410A having a non-flammability (for example, 1 according to the classification of ASHRAE 34) may be used. The above-mentioned refrigerant has a density higher than air under the atmospheric pressure (for example, at a room temperature (25 degrees Celsius)).

At least the heat-source-side heat exchanger 5 is accommodated in the outdoor unit 2. In this example, the compressor 3, the refrigerant flow switching unit 4, and the pressure-reducing unit 6 are also accommodated in the outdoor unit 2. Moreover, an outdoor air-sending fan 8 that supplies outdoor air to the heat-source-side heat exchanger 5 is accommodated in the outdoor unit 2. The outdoor air-sending fan 8 is installed facing the heat-source-side heat exchanger 5. By rotating the outdoor air-sending fan 8, air flow passing through the heat-source-side heat exchanger 5 is generated. For example, a propeller fan is used as the outdoor air-sending fan 8. For example, the outdoor air-sending fan 8 is arranged on the downstream side of the heat-source-side heat exchanger 5 in the air flow generated by the outdoor air-sending fan 8.

The compressor 3 is a fluid machine that compresses sucked low-pressure refrigerant and discharges the compressed refrigerant as high-pressure refrigerant. The refrigerant flow switching unit 4 switches, according to whether a cooling operation or a heating operation is performed, the direction in which refrigerant flows in the refrigeration cycle circuit 10. For example, a four-way valve or a plurality of two-way valves is used as the refrigerant flow switching unit 4. The heat-source-side heat exchanger 5 is a heat exchanger that functions as a radiator (for example, a condenser) when a cooling operation is performed and functions as an evaporator when a heating operation is performed. The heat-source-side heat exchanger 5 performs heat exchange between refrigerant flowing inside the heat-source-side heat exchanger 5 and outdoor air sent by the outdoor air-sending fan 8. The pressure-reducing unit 6 decompresses high-pressure refrigerant into low-pressure refrigerant. For example, an electronic expansion valve or other units whose opening degree can be adjusted by the control of a controller 30, which will be described later, is used as the pressure-reducing unit 6. Furthermore, a temperature-type expansion valve, a fixed aperture, an expander, or other units may be used as the pressure-reducing unit 6.

The load-side heat exchanger 7A is accommodated in the indoor unit 1A. Furthermore, an indoor air-sending fan 9A that supplies air to the load-side heat exchanger 7A is accommodated in the indoor unit 1A. An air inlet that sucks air in an indoor space and an air outlet that blows air into the indoor space are formed at the housing of the indoor unit 1A. By rotating the indoor air-sending fan 9A, air in the indoor space is sucked through the air inlet. The sucked air passes through the load-side heat exchanger 7A and is blown into the indoor space through the air outlet. As the indoor air-sending fan 9A, depending on the form of the indoor unit 1A, a centrifugal fan (for example, a sirocco fan, a turbo fan, or other types of fan), a cross-flow fan, a diagonal flow fan, an axial flow fan (for example, a propeller fan), or other types of fan is used. The indoor air-sending fan 9A according to this example is arranged on the upstream side of the load-side heat exchanger 7A in the air flow generated by the indoor air-sending fan 9A, The indoor air-sending fan 9A may be arranged on the downstream side of the load-side heat exchanger 7A.

The load-side heat exchanger 7A is a heat exchanger that functions as an evaporator when a cooling operation is performed and functions as a radiator (for example, a condenser) when a heating operation is performed. The load-side heat exchanger 7A performs heat exchange between refrigerant flowing inside the load-side heat exchanger 7A and air sent by the indoor air-sending fan 9A.

Furthermore, in the indoor unit 1A, a refrigerant detection unit 99A that detects leakage of refrigerant is provided. The refrigerant detection unit 99A is arranged, for example, inside the housing of the indoor unit 1A. As the refrigerant detection unit 99A, for example, a gas sensor such as a semiconductor gas sensor or a hot-wire-type semiconductor gas sensor is used. For example, the refrigerant detection unit 99A detects the density of refrigerant in the air around the refrigerant detection unit 99A and outputs a detection signal to the controller 30, which will be described later. The controller 30 determines, based on the detection signal from the refrigerant detection unit 99A, whether or not there is a leakage of refrigerant in the indoor unit 1A. Furthermore, as the refrigerant detection unit 99A, an oxygen concentration meter may be used or a temperature sensor (for example, a thermistor) may be used. In the case where a temperature sensor is used as the refrigerant detection unit 99A, the refrigerant detection unit 99A detects leakage of refrigerant by detecting a decrease in temperature caused by adiabatic expansion of refrigerant that has leaked.

Positions where leakage of refrigerant may occur in the indoor unit 1A is a brazing part of the load-side heat exchanger 7A and a connection part of refrigerant pipes. Furthermore, refrigerant used in Embodiment 1 has a density higher than air under the atmospheric pressure. Therefore, when leakage of refrigerant occurs in the indoor unit 1A, the refrigerant flows in a downward direction in the housing of the indoor unit 1A. Thus, it is desirable that the refrigerant detection unit 99A should be provided at a position lower than the load-side heat exchanger 7A and the connection part in the housing of the indoor unit 1A (for example, a lower part inside the housing). Accordingly, the refrigerant detection unit 99A can reliably detect leakage of refrigerant at least when the indoor air-sending fan 9A is stopped.

As the indoor unit 1A, for example, an indoor unit of a floor type, a ceiling cassette type, a ceiling concealed type, a ceiling suspended type, a wall hanging type, or other types is used.

The indoor units 1B and 1C have a configuration similar to, for example, the indoor unit 1A. That is, the load-side heat exchangers 7B and 7C and the indoor air-sending fans 9B and 9C are accommodated in the indoor units 1B and 1C, respectively, as in the indoor unit 1A. Furthermore, refrigerant detection units 99B and 99C are provided in the indoor units 1B and 1C, respectively, as in the indoor unit 1A.

The controller 30 (not illustrated in FIG. 1) includes a microcomputer including a CPU, a ROM, a RAM, an I/O port, and other units. The controller 30 in this example controls an operation of the entire air-conditioning apparatus including the indoor units 1A, 1B, and 1C, based on an operation signal from an operation unit (for example, a remote controller) that receives an operation by a user, detection signals from sensors, or other signals. As described later, the controller 30 in this example includes an outdoor unit control unit that is provided at the outdoor unit 2 and a plurality of indoor unit control units that are provided at the indoor units 1A, 1B, and 1C and can perform data communication with the outdoor unit control unit. The outdoor unit control unit mainly controls an operation of the outdoor unit 2. The indoor unit control units mainly control operations of the indoor units 1A, 1B, and 1C.

An operation of the refrigeration cycle circuit 10 of the air-conditioning apparatus will be explained. First, an operation performed during a cooling operation will be explained. In FIG. 1, the direction in which refrigerant flows during a cooling operation is represented by solid arrows. During a cooling operation, the flow passage of refrigerant is switched by the refrigerant flow switching unit 4, as represented by solid lines in FIG. 1, and the refrigeration cycle circuit 10 is configured such that low-temperature, low-pressure refrigerant flows to the load-side heat exchangers 7A, 7B, and 7C.

High-temperature, high-pressure gas refrigerant discharged from the compressor 3 passes through the refrigerant flow switching unit 4 and flows into the heat-source-side heat exchanger 5. During a cooling operation, the heat-source-side heat exchanger 5 functions as a condenser. That is, the heat-source-side heat exchanger 5 performs heat exchange between refrigerant flowing inside the heat-source-side heat exchanger 5 and outdoor air supplied by the outdoor air-sending fan 8, and condensation heat of the refrigerant is transferred to the outdoor air. Accordingly, the refrigerant that has flowed into the heat-source-side heat exchanger 5 condenses into high-pressure liquid refrigerant. The high-pressure liquid refrigerant that has flowed out of the heat-source-side heat exchanger 5 flows into the pressure-reducing unit 6 and is decompressed into low-pressure two-phase refrigerant. The low-pressure two-phase refrigerant that has flowed out of the pressure-reducing unit 6 flows through an extension pipe and flows into the load-side heat exchangers 7A, 7B, and 7C of the indoor units 1A, 1B, and 1C. During a cooling operation, the load-side heat exchangers 7A, 7B, and 7C function as evaporators. That is, the load-side heat exchangers 7A, 7B, and 7C perform heat exchange between refrigerant flowing inside the load-side heat exchangers 7A, 7B, and 7C and air (for example, indoor air) supplied by the indoor air-sending fans 9A, 9B, and 9C, and evaporation heat of the refrigerant is received from the air. Accordingly, the refrigerant that has flowed into the load-side heat exchangers 7A, 7B, and 7C evaporates and turns into low-pressure gas refrigerant or high-quality two-phase refrigerant. Furthermore, the air supplied by the indoor air-sending fans 9A, 9B, and 9C is cooled down by a heat removal function of the refrigerant. The low-pressure gas refrigerant or high-quality two-phase refrigerant flowing out of the load-side heat exchangers 7A, 7B, and 7C passes through the extension pipe and the refrigerant flow switching unit 4 and is sucked into the compressor 3. The refrigerant sucked into the compressor 3 is compressed into high-temperature, high-pressure gas refrigerant. During the cooling operation, the above-described cycle is performed repeatedly.

Next, an operation performed during a heating operation will be explained. In FIG. 1, the direction in which refrigerant flows during a heating operation is represented by dotted arrows. During a heating operation, the flow passage of refrigerant is switched by the refrigerant flow switching unit 4, as represented by dotted lines in FIG. 1, and the refrigeration cycle circuit 10 is configured such that high-temperature, high-pressure refrigerant flows to the load-side heat exchangers 7A, 7B, and 7C.

High-temperature, high-pressure gas refrigerant discharged from the compressor 3 passes through the refrigerant flow switching unit 4 and the extension pipe and flows into the load-side heat exchangers 7A, 7B, and 7C of the indoor units 1A, 1B, and 1C, During a heating operation, the load-side heat exchangers 7A, 7B, and 7C function as condensers. That is, the load-side heat exchangers 7A, 7B, and 7C perform heat exchange between refrigerant flowing inside the load-side heat exchangers 7A, 7B, and 7C and air supplied by the indoor air-sending fans 9A, 9B, and 9C, and condensation heat of the refrigerant is transferred to the outdoor air. Accordingly, the refrigerant that has flowed into the load-side heat exchangers 7A, 7B, and 7C condenses into high-pressure liquid refrigerant. The high-pressure liquid refrigerant condensed by the load-side heat exchangers 7A, 7B, and 7C passes through the extension pipe, flows into the pressure-reducing unit 6 of the outdoor unit 2, and is decompressed into a low-pressure two-phase refrigerant. The low-pressure two-phase refrigerant that has flowed out of the pressure-reducing unit 6 flows into the heat-source-side heat exchanger 5. During a heating operation, the heat-source-side heat exchanger 5 functions as an evaporator. That is, the heat-source-side heat exchanger 5 performs heat exchange between refrigerant flowing inside the heat-source-side heat exchanger 5 and outdoor air supplied by the outdoor air-sending fan 8, and evaporation heat of the refrigerant is received from the outdoor air. Accordingly, the refrigerant that has flowed into the heat-source-side heat exchanger 5 evaporates and turns into low-pressure gas refrigerant or high-quality two-phase refrigerant. The low-pressure gas refrigerant or high-quality two-phase refrigerant that has flowed out of the heat-source-side heat exchanger 5 passes through the refrigerant flow switching unit 4 and is sucked into the compressor 3. The refrigerant sucked into the compressor 3 is compressed into high-temperature, high-pressure gas refrigerant. During the heating operation, the above-described cycle is performed repeatedly.

The air-conditioning apparatus according to Embodiment 1 is an air-conditioning apparatus of a so-called simultaneous-operation multiple type in which all the indoor units 1A, 1B, 1C that are connected to the refrigeration cycle circuit 10 operate in the same operation mode. Operation patterns of the air-conditioning apparatus of the simultaneous-operation multiple type are categorized into, for example, a first operation pattern in which all the indoor units 1A, 1B, and 1C perform a cooling operation, a second operation pattern in which all the indoor units 1A, 1B, and 1C perform a heating operation, and a third operation pattern in which all the indoor units 1A, 1B, and 1C are stopped.

Figure 2:
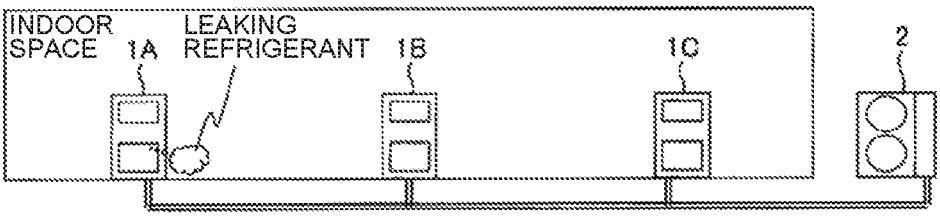
FIG. 2 is a diagram illustrating an example of a state in which indoor units 1A, 1B, and 1C are installed in the air-conditioning apparatus according to Embodiment 1 of the present invention.

FIG. 2 is a diagram illustrating an example of a state in which the indoor units 1A, 1B, and 1C are installed in the air-conditioning apparatus according to Embodiment 1. In the case of an air-conditioning apparatus of the simultaneous-operation multiple type, as illustrated in FIG. 2, in general, all the indoor units 1A, 1B, and 1C are installed in an indoor space with no partitions. In FIG. 2, the indoor units 1A, 1B, and 1C of a floor type are illustrated as an example. However, the indoor units 1A, 1B, and 1C may be of a ceiling cassette type, a ceiling concealed type, a ceiling suspended type, or a wall hanging type.

Figure 3:
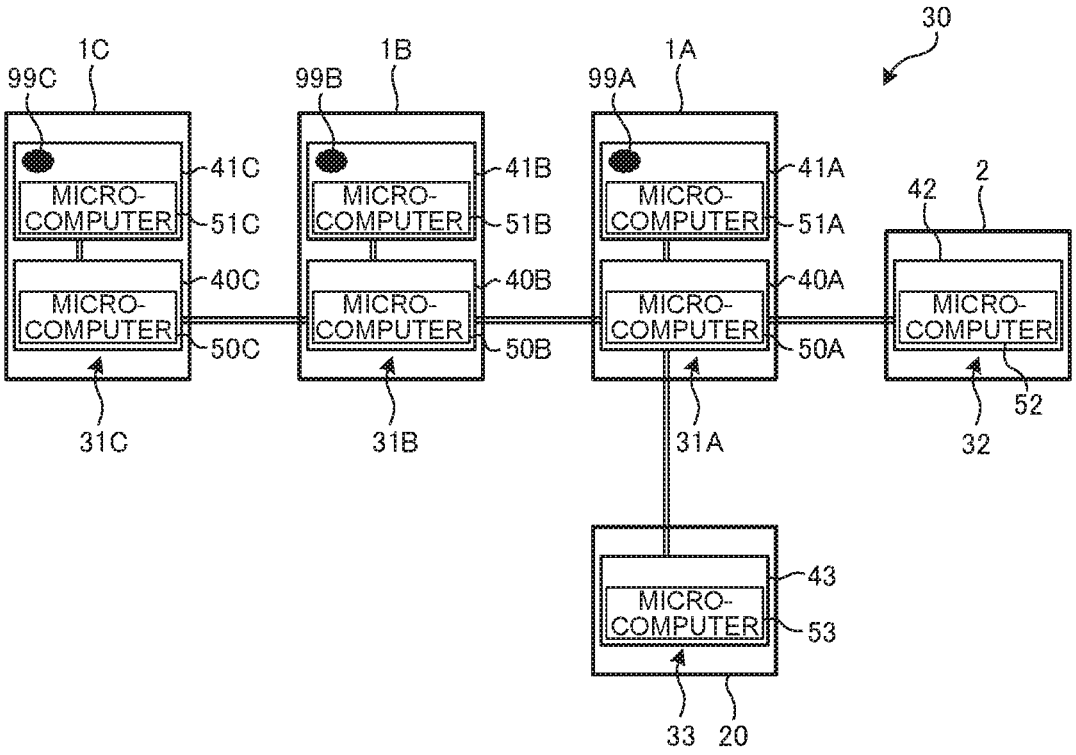
FIG. 3 is a block diagram illustrating a configuration of a controller 30 of the air-conditioning apparatus according to Embodiment 1 of the present invention.

FIG. 3 is a block diagram illustrating a configuration of the controller 30 of the air-conditioning apparatus according to Embodiment 1. As illustrated in FIG. 3, the controller 30 includes an indoor unit control unit 31A that is mounted in the indoor unit 1A and controls the indoor unit 1A, an indoor unit control unit 31B that is mounted in the indoor unit 1B and controls the indoor unit 1B, an indoor unit control unit 31C that is mounted in the indoor unit 1C and controls the indoor unit 1C, an outdoor unit control unit 32 that is mounted in the outdoor unit 2 and controls the outdoor unit 2, and a remote controller control unit 33 that is mounted in a remote controller 20 serving as an operation unit and controls the remote controller 20.

The indoor unit control unit 31A includes a control substrate 40A and a control substrate 41A that can communicate with the control substrate 40A via a control line. The indoor unit control unit 31A is configured to be capable of communicating with the indoor unit control unit 31B, the indoor unit control unit 31C, the outdoor unit control unit 32, and the remote controller control unit 33 via control lines. On the control substrate 40A, a microcomputer 50A that mainly controls an operation of the indoor unit 1A is mounted. On the control substrate 41A, the refrigerant detection unit 99A (for example, a hot-wire-type semiconductor gas sensor) and a microcomputer 51A that mainly controls the refrigerant detection unit 99A are non-detachably mounted. The refrigerant detection unit 99A in this example is directly mounted on the control substrate 41A. However, the refrigerant detection unit 99A only needs to be non-detachably mounted on the control substrate 41A. For example, the refrigerant detection unit 99A may be provided at a position away from the control substrate 41A and wire from the refrigerant detection unit 99A may be connected to the control substrate 41A by soldering or other methods. Furthermore, although the control substrate 41A is provided separately from the control substrate 40A, the control substrate 41A may be omitted and the refrigerant detection unit 99A may be non-detachably connected on the control substrate 40A.

The indoor unit control units 31B and 31C have a configuration similar to that of the indoor unit control unit 31A. That is, the indoor unit control units 31B and 31C include control substrates 40B and 40C on which microcomputers 50B and 50C are mounted and control substrates 41B and 41C on which the microcomputers 51B and 51C and the refrigerant detection units 99B and 99C are mounted, respectively.

The outdoor unit control unit 32 includes a control substrate 42. On the control substrate 42, a microcomputer 52 that mainly controls an operation of the outdoor unit 2 is mounted.

The remote controller control unit 33 includes a control substrate 43. On the control substrate 43, a microcomputer 53 that mainly controls the remote controller 20 is mounted.

The indoor unit control units 31A, 31B, and 31C, the outdoor unit control unit 32, and the remote controller control unit 33 can communicate with one another. In this example, the indoor unit control unit 31A is connected to each of the outdoor unit control unit 32 and the remote controller control unit 33 via control lines. The indoor unit control units 31A, 31B, and 31C are connected in a bus type via control lines.

The microcomputers 51A, 51B, and 51C each include a rewritable nonvolatile memory (for example, flash memory). A leakage history bit (an example of a leakage history memory region) that stores histories of refrigerant leakage is provided in the nonvolatile memory. Leakage history bits of the microcomputers 51A, 51B, and 51C may be set to "0" or "1". The initial value of a leakage history bit is "0". That is, for the microcomputers 51A, 51B, and 51C in a brand-new state or the microcomputers 51A, 51B, and 51C having no refrigerant leakage history, the leakage history bit is set to "0".

When the refrigerant detection unit 99A detects leakage of refrigerant (for example, when the density of refrigerant detected by the refrigerant detection unit 99A is equal to or more than a threshold density), the leakage history bit of the microcomputer 51A is rewritten from "0" to "1". In a similar manner, when the refrigerant detection units 99B and 99C detect leakage of refrigerant, the leakage history bits of the microcomputers 51B and 51C are rewritten from "0" to "1". The leakage history bits of the microcomputers 51A, 51B, and 51C are irreversibly rewritable only in one direction from "0" to "1". Furthermore, the leakage history bits of the microcomputers 51A, 51B, and 51C are maintained without depending on whether or not power is supplied to the microcomputers 51A, 51B, and 51C.

Furthermore, in each of the memories (nonvolatile memories or volatile memories) of the microcomputers 50A, 50B, 50C, 52, and 53, a first leakage history bit corresponding to the leakage history bit of the microcomputer 51A, a second leakage history bit corresponding to the leakage history bit of the microcomputer 51B, and a third leakage history bit corresponding to the leakage history bit of the microcomputer 51C are provided. The first to third leakage history bits of each of the microcomputers 50A, 50B, 50C, 52, and 53 may be set to "0" or "1". The first to third leakage history bits of each of the microcomputers 50A, 50B, 50C, 52, and 53 are bidirectionally rewritable between "0" and "1". The value of the first leakage history bit of each of the microcomputers 50A, 50B, 50C, 52, and 53 is set to the same value as the leakage history bit of the microcomputer 51A acquired by communication. The value of the second leakage history bit of each of the microcomputers 50A, 50B, 50C, 52, and 53 is set to the same value as the leakage history bit of the microcomputer 51B acquired by communication. The value of the third leakage history bit of each of the microcomputers 50A, 50B, 50C, 52, and 53 is set to the same value as the leakage history bit of the microcomputer 51C acquired by communication. Even if power supply is interrupted and the values of the first to third leakage history bits of the microcomputers 50A, 50B, 50C, 52, and 53 are returned to the initial value (for example, "0"), once power supply resumes, the first to third leakage history bits of the microcomputers 50A, 50B, 50C, 52, and 53 are set to the same values as the leakage history bits of the microcomputers 51A, 51B, and 51C.

In the case where all the first to third leakage history bits of the microcomputer 50A are set to "0", the indoor unit control unit 31A performs normal control for the indoor unit 1A. The indoor unit 1A in this state performs normal operating action and stopping action, based on an operation of the remote controller 20 or other devices. In contrast, in the case where any one of the first to third leakage history bits of the microcomputer 50A is set to "1", the indoor unit control unit 31A performs control such that the indoor air-sending fan 9A is forcedly operated. That is, the operation of the indoor air-sending fan 9A is continued while the indoor unit 1A is operating, whereas the operation of the indoor air-sending fan 9A is started when the indoor unit 1A is stopped. The operation of the indoor air-sending fan 9A is continued as long as, for example, any one of the first to third leakage history bits of the microcomputer 50A is set to "1".

In the case where all the first to third leakage history bits of the microcomputer 50B are set to "0", the indoor unit control unit 31B performs normal control for the indoor unit 1B. The indoor unit 1B in this state performs an operating action and a stopping action as in the indoor unit 1A, based on an operation of the remote controller 20 or other devices. In contrast, in the case where any one of the first to third leakage history bits of the microcomputer 50B is set to "1", the indoor unit control unit 31B performs control such that the indoor air-sending fan 9B is forcedly operated. That is, the operation of the indoor air-sending fan 9B is continued while the indoor unit 1B is operating, whereas the operation of the indoor air-sending fan 9B is started when the indoor unit 1B is stopped. The operation of the indoor air-sending fan 9B is continued as long as, for example, any one of the first to third leakage history bits of the microcomputer 50B is set to "1".

In the case where all the first to third leakage history bits of the microcomputer 50C are set to "0", the indoor unit control unit 31C performs normal control for the indoor unit 1C. The indoor unit 1C in this state performs an operating action and a stopping action as in the indoor unit 1A, based on an operation of the remote controller 20 or other devices. In contrast, in the case where any one of the first to third leakage history bits of the microcomputer 50C is set to "1", the indoor unit control unit 31C performs control such that the indoor air-sending fan 9C is forcedly operated. That is, the operation of the indoor air-sending fan 9C is continued while the indoor unit 1C is operating, whereas the operation of the indoor air-sending fan 9C is started when the indoor unit 1C is stopped. The operation of the indoor air-sending fan 9C is continued as long as, for example, any one of the first to third leakage history bits of the microcomputer 50C is set to "1".

In the case where all the first to third leakage history bits of the microcomputer 52 are set to "0", the outdoor unit control unit 32 performs normal control for the outdoor unit 2. In contrast, in the case where any one of the first to third leakage history bits of the microcomputer 52 is set to "1", the outdoor unit control unit 32 controls the compressor 3 to stop or performs control such that the operation of the compressor 3 is prohibited. The above-mentioned control is continued as long as any one of the first to third leakage history bits of the microcomputer 52 is set to "1".

When all the first to third leakage history bits of the microcomputer 53 are set to "0", the remote controller control unit 33 performs normal control for the remote controller 20. In contrast, when any one of the first to third leakage history bits of the microcomputer 53 is set to "1", for example, the remote controller control unit 33 displays information including a type of abnormality or a treatment method (for example, a character message such as "Refrigerant is leaking. Please contact a service person.", abnormality code, or other types of information) on the display unit provided at the remote controller 20. At this time, the remote controller control unit 33 may display information of a position where leakage of refrigerant has occurred on the display unit, according to which one of the first to third leakage history bits the value "1" is set to. For example, information indicating that leakage of refrigerant has occurred in the indoor unit 1A is displayed when the first leakage history bit is set to "1", information indicating that leakage of refrigerant has occurred in the indoor unit 1B is displayed when the second leakage history bit is set to "1", and information indicating that leakage of refrigerant has occurred in the indoor unit 1C when the third leakage history bit is set to "1". The above-mentioned display is continued as long as any one of the first to third leakage history bits of the microcomputer 53 is set to "1". Furthermore, the remote controller control unit 33 may cause a sound output unit provided at the remote controller 20 to output, by sound, information including a type of abnormality, a treatment method, or a position where leakage of refrigerant has occurred.

With this configuration, when leakage of refrigerant occurs in the indoor unit 1A, as illustrated in FIG. 2, the refrigerant detection unit 99A of the indoor unit 1A detects the leakage of refrigerant. When the leakage of refrigerant is detected by the refrigerant detection unit 99A, the microcomputer 51A irreversibly rewrites the leakage history bit from the initial value "0" to "1". When the leakage history bit of the microcomputer 51A is set to "1", the first leakage history bit of each of the microcomputers 50A, 50B, 50C, 52, and 53 is also rewritten from "0" to "1". Accordingly, forced operation of all the indoor air-sending fans 9A, 9B, and 9C, stopping of the compressor 3, inhibition of operation of the compressor 3, display of information on the display unit of the remote controller 20, and other types of processing are performed.

When leakage of refrigerant occurs in the indoor unit 1B, the refrigerant detection unit 99B detects the leakage of refrigerant. When the leakage of refrigerant is detected by the refrigerant detection unit 99B, the microcomputer 51B irreversibly rewrites the leakage history bit from the initial value "0" to "1". When the leakage history bit of the microcomputer 51B is set to "1", the second leakage history bit of each of the microcomputers 50A, 50B, 50C, 52, and 53 is also rewritten from "0" to "1". Accordingly, forced operation of all the indoor air-sending fans 9A, 9B, and 9C, stopping of the compressor 3, inhibition of operation of the compressor 3, display of information on the display unit of the remote controller 20, and other types of processing are performed.

When leakage of refrigerant occurs in the indoor unit 1C, the refrigerant detection unit 99C detects the leakage of refrigerant. When the leakage of refrigerant is detected by the refrigerant detection unit 99C, the microcomputer 51C irreversibly rewrites the leakage history bit from the initial value "0" to "1". When the leakage history bit of the microcomputer 51C is set to "1", the third leakage history bit of each of the microcomputers 50A, 50B, 50C, 52, and 53 is also rewritten from "0" to "1". Accordingly, forced operation of all the indoor air-sending fans 9A, 9B, and 9C, stopping of the compressor 3, inhibition of operation of the compressor 3, display of information on the display unit of the remote controller 20, and other types of processing are performed.

When a service person is contacted by a user, he or she fixes the position where leakage of refrigerant has occurred by replacing the control substrate 41A, 41B, or 41C at which leakage of refrigerant has been detected with a brand-new one. This is because the leakage history bit of the microcomputer 51A, 51B, or 51C is maintained at "1" when the position where the leakage of refrigerant has occurred is simply fixed, and therefore, the air-conditioning apparatus cannot perform a normal action. The refrigerant detection units 99A, 99B, and 99C are non-detachably connected to the control substrates 41A, 41B, and 41C, respectively. Therefore, when the control substrate 41A, 41B, or 41C is replaced, the refrigerant detection unit 99A, 99B, or 99C that is exposed to refrigerant atmosphere is also replaced at the same time.

The leakage history bit of the microcomputer 51A, 51B, or 51C mounted on the new control substrate 41A, 41B, or 41C is set to the initial value "0". Therefore, the leakage history bit of each of the microcomputers 50A, 50B, 50C, 52, and 53 is also rewritten from "1" to "0". Accordingly, the air-conditioning apparatus can perform a normal action.

In Embodiment 1, when leakage of refrigerant occurs in, for example, the indoor unit 1A among the plurality of indoor units 1A, 1B, and 1C that are installed in an indoor space, the refrigerant detection unit 99A of the indoor unit 1A detects the leakage of refrigerant. Information indicating that the leakage of refrigerant has occurred in the indoor unit 1A is transmitted from the indoor unit control unit 31A to the other indoor unit control units 31B and 31C, the outdoor unit control unit 32, and the remote controller control unit 33 via control lines. Accordingly, the information indicating that the leakage of refrigerant has occurred in the indoor unit 1A is shared not only with the indoor unit control unit 31A but also with the other indoor unit control units 31B and 31C, the outdoor unit control unit 32, and the remote controller control unit 33. The indoor unit control units 31A, 31B, and 31C perform control such that the indoor air-sending fans 9A, 9B, and 9C are forcedly operated in accordance with the information.

In general, an indoor space in which the plurality of indoor units 1A, 1B, and 1C are installed is a large space having a large floor area. A high air-conditioning capacity is required for an air-conditioning apparatus that performs air conditioning of a large space. Therefore, an amount of refrigerant corresponding to the air conditioning capacity is filled in the refrigeration cycle circuit 10. In contrast, even if only the indoor air-sending fan 9A of the indoor unit 1A is forcedly operated when leakage of refrigerant occurs in the indoor unit 1A, the air volume necessary for diffusing refrigerant that has leaked into an indoor space may not be obtained. In short, the air volume corresponding to the large space can be secured by the air volume of the three indoor units 1A, 1B, and 1C. Therefore, to obtain the air volume necessary for diffusion of refrigerant only with a fan of a single indoor unit, each indoor unit needs to include a large-size fan or a high-output motor that is not necessary for the air volume for a normal operation.

In contrast, in Embodiment 1, when leakage of refrigerant occurs in any one of the plurality of indoor units 1A, 1B, and 1C, not only an indoor air-sending fan of the indoor unit in which the leakage of refrigerant has occurred but also indoor air-sending fans of all the other indoor units can be operated. Accordingly, even in the case where the floor area of an indoor space is large, refrigerant that has leaked can be sufficiently diffused into the indoor space, without increasing the cost by an increase in the size of a fan, an increase in the output performance of a motor, or other increases. Therefore, even if leakage of refrigerant occurs, a situation in which the density of refrigerant in the indoor space is locally increased can be prevented. As a result, the density of refrigerant in the indoor space can be prevented from increasing to an allowable value or more. In addition, even in the case where a flammable refrigerant is used, a flammable density region is prevented from being formed in the indoor space.

Furthermore, in Embodiment 1, when leakage of refrigerant occurs in any one of the indoor units 1A, 1B, and 1C, indoor air-sending fans of all the indoor units start to operate. Accordingly, a sudden operation starting action, which is different from a normal action, is performed in each of the indoor units. Therefore, more people can be informed of a situation in which abnormality such as leakage of refrigerant has occurred. Consequently, a response such as opening a window or other actions can be performed more reliably.

Furthermore, in Embodiment 1, for example, when leakage of refrigerant occurs in the indoor unit 1A, the refrigerant detection unit 99A detects the leakage of refrigerant, and leakage history of refrigerant is irreversibly written to the nonvolatile memory of the control substrate 41A. To reset the leakage history of refrigerant, the control substrate 41A needs to be replaced with another control substrate that has no leakage history. When the control substrate 41A is replaced, the refrigerant detection unit 99A, which is non-detachably connected, is also replaced at the same time. Therefore, a situation in which the refrigerant detection unit 99A that is exposed to refrigerant atmosphere and has changed detection characteristics is continuously used may be prevented. Furthermore, in Embodiment 1, the operation of the air-conditioning apparatus cannot be resumed until the control substrate 41A has been replaced. Therefore, a situation in which the operation of the air-conditioning apparatus in which the position where leakage of refrigerant has occurred has not been fixed is resumed by human error or resumed intentionally can be prevented.

The air-conditioning apparatus according to Embodiment 1 is not limited to the system configurations illustrated in FIGS. 1 to 3. Modifications of a system configuration of an air-conditioning apparatus will be described below.

(Modification 1)

Figure 4:
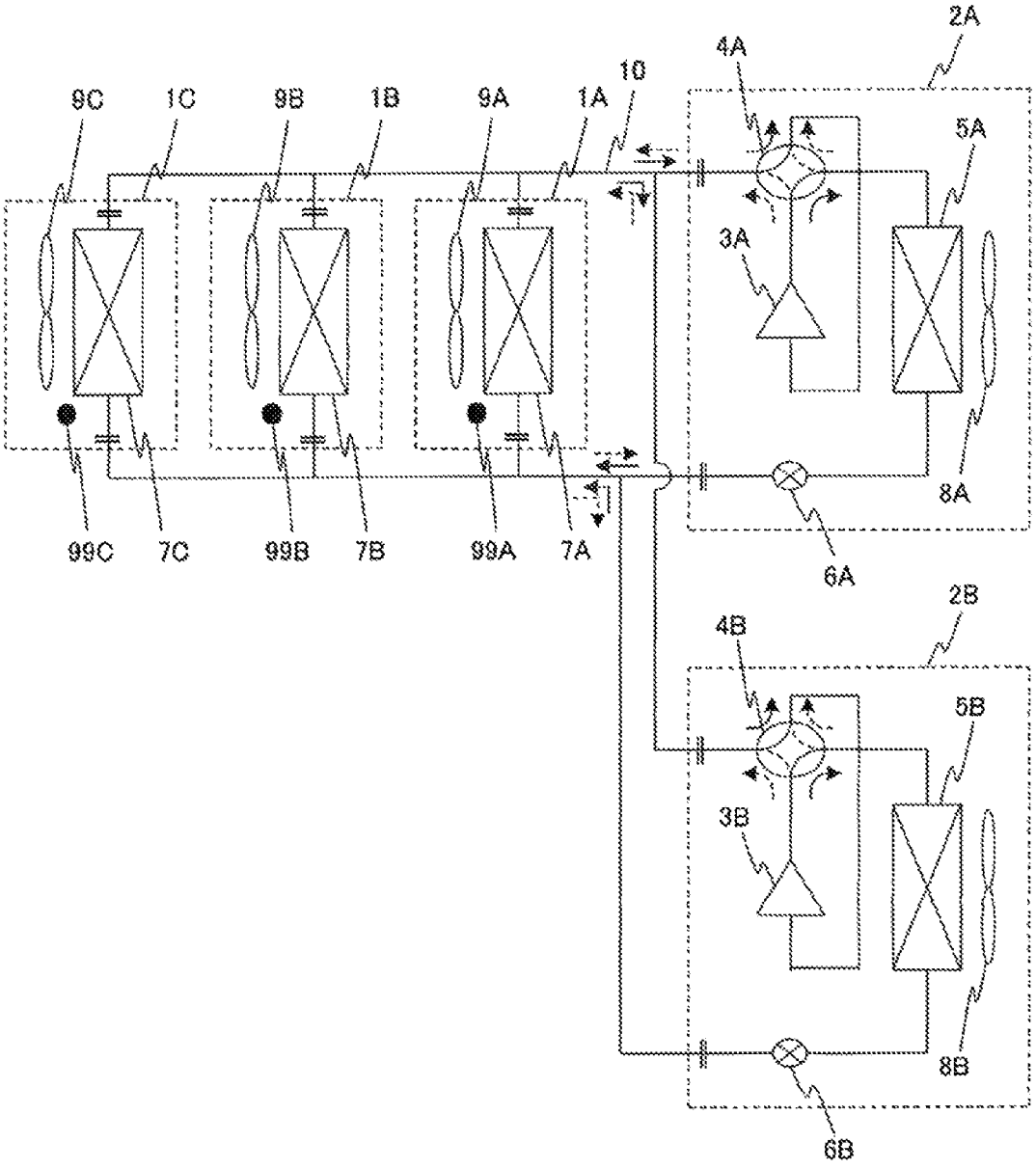
FIG. 4 is a refrigerant circuit diagram illustrating a schematic configuration of an air-conditioning apparatus according to Modification 1 of Embodiment 1 of the present invention.

FIG. 4 is a refrigerant circuit diagram illustrating a schematic configuration of an air-conditioning apparatus according to Modification 1 of Embodiment 1. As illustrated in FIG. 4, the air-conditioning apparatus according to Modification 1 includes a plurality of outdoor units 2A and 2B. The outdoor units 2A and 2B are provided in parallel to each other in the refrigeration cycle circuit 10. A compressor 3A, a refrigerant flow switching unit 4A, a heat-source-side heat exchanger 5A, a pressure-reducing unit 6A, and an outdoor air-sending fan 8A are accommodated in the outdoor unit 2A. A compressor 3B, a refrigerant flow switching unit 4B, a heat-source-side heat exchanger 5B, a pressure-reducing unit 6B, and an outdoor air-sending fan 8B are accommodated in the outdoor unit 2B. Although illustration is omitted, outdoor unit control units provided in the outdoor units 2A and 2B are connected to the indoor unit control units 31A, 31B, and 31C and the remote controller control unit 33 such that the outdoor unit control units can communicate with the indoor unit control units 31A, 31B, and 31C and the remote controller control unit 33. The other configurations are similar to those illustrated in FIGS. 1 to 3. Also in Modification 1, effects similar to those obtained with the configurations illustrated in FIGS. 1 to 3 can be achieved.

(Modification 2)

Figure 5:
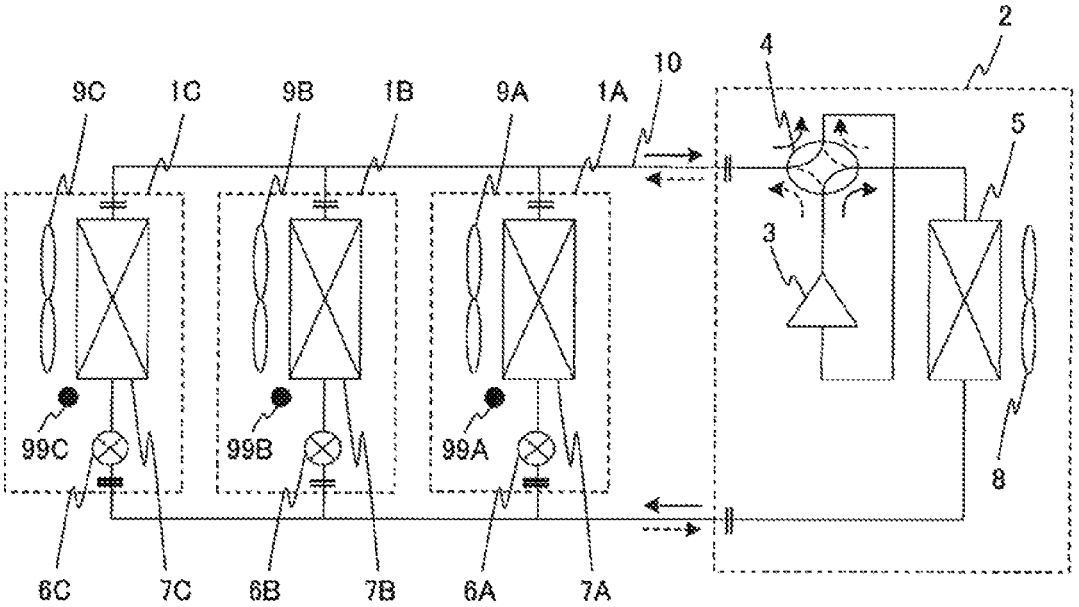
FIG. 5 is a refrigerant circuit diagram illustrating a schematic configuration of an air-conditioning apparatus according to Modification 2 of Embodiment 1 of the present invention.

FIG. 5 is a refrigerant circuit diagram illustrating a schematic configuration of an air-conditioning apparatus according to Modification 2 of Embodiment 1. As illustrated in FIG. 5, the air-conditioning apparatus according to Modification 2 includes pressure-reducing units 6A, 6B, and 6C corresponding to the indoor units 1A, 1B, and 1C, respectively. The pressure-reducing units 6A, 6B, and 6C are accommodated in the indoor units 1A, 1B, and 1C, respectively.

The air-conditioning apparatus illustrated in FIGS. 1 and 3 is an air-conditioning apparatus of a simultaneous-operation multiple type in which all the indoor units 1A, 1B, and 1C operate in the same operation mode. Therefore, only the pressure-reducing unit 6 is provided in the outdoor unit 2. In a similar manner, the air-conditioning apparatus according to Modification 1 illustrated in FIG. 4 is an air-conditioning apparatus of a simultaneous-operation multiple type in which all the indoor units 1A, 1B, and 1C operate in the same operation mode. Therefore, the pressure-reducing units 6A and 6B are provided in the outdoor units 2A and 2B, respectively.

In contrast, the air-conditioning apparatus according to Modification 2 is an air-conditioning apparatus of a so-called individual-operation multiple type in which, for example, all the indoor units 1A, 1B, and 1C operate in operation modes that are independent of one another. During a cooling operation, each of the indoor units 1A, 1B, and 1C performs a cooling operation or stops, in a manner in which they are independent of one another. During a heating operation, each of the indoor units 1A, 1B, and 1C performs a heating operation or stops, in a manner in which they are independent of one another. That is, in the air-conditioning apparatus of the individual-operation multiple type, only part of the indoor units 1A, 1B, and 1C may be operated. In the configuration illustrated in FIG. 5, the indoor units 1A, 1B, and 1C cannot perform a cooling operation and a heating operation in a coexisting manner. However, depending on the configuration of the refrigeration cycle circuit 10, the indoor units 1A, 1B, and 1C can perform a cooling operation and a heating operation in a coexisting manner.

In the case of an air-conditioning apparatus of an individual-operation multiple type, in general, the indoor units 1A, 1B, and 1C are installed in a plurality of indoor spaces divided by walls or partitions. However, even in the case of an air-conditioning apparatus of the individual-operation multiple type, all the indoor units 1A, 1B, and 1C may be installed in an indoor space, as illustrated in FIG. 2.

Figure 6:
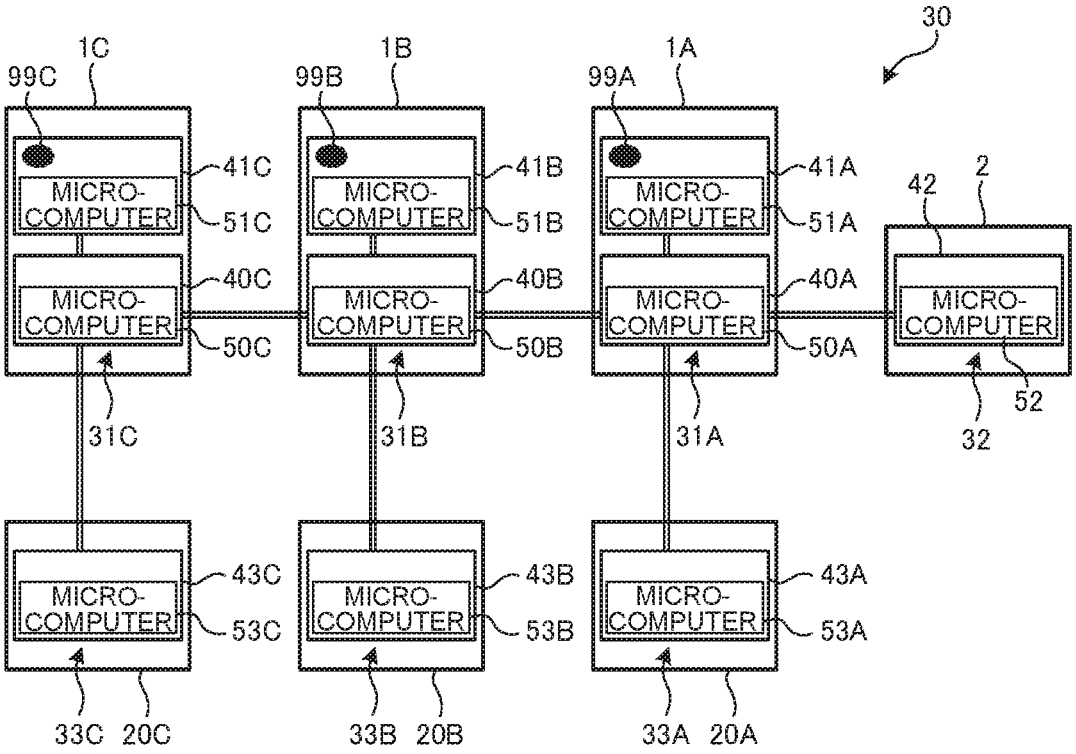
FIG. 6 is a block diagram illustrating a configuration of a controller 30 of the air-conditioning apparatus according to Modification 2 of Embodiment 1 of the present invention.

FIG. 6 is a block diagram illustrating a configuration of the controller 30 of the air-conditioning apparatus according to Modification 2. As illustrated in FIG. 6, in Modification 2, the indoor units 1A, 1B, and 1C include the remote controllers 20A, 20B, and 200, respectively. The controller 30 includes the indoor unit control unit 31A that is mounted in the indoor unit 1A and controls the indoor unit 1A, the indoor unit control unit 31B that is mounted in the indoor unit 1B and controls the indoor unit 1B, the indoor unit control unit 31C that is mounted in the indoor unit 1C and controls the indoor unit 1C, the outdoor unit control unit 32 that is mounted in the outdoor unit 2 and controls the outdoor unit 2, a remote controller control unit 33A that is mounted in the remote controller 20A and controls the remote controller 20A, a remote controller control unit 33B that is mounted in the remote controller 20B and controls the remote controller 20B, and a remote controller control unit 33C that is mounted in the remote controller 20C and controls the remote controller 20C.

The configuration of the indoor unit control units 31A, 31B, and 31C and the outdoor unit control unit 32 is the same as that illustrated in FIG. 3.

The remote controller control unit 33A includes a control substrate 43A. A microcomputer 53A is mounted on the control substrate 43A. In a similar manner, the remote controller control units 33B and 33C include control substrates 43B and 43C on which microcomputers 53B and 53C are mounted, respectively. The remote controller control units 33A, 33B, and 33C are connected to the indoor unit control units 31A, 31B, and 31C, respectively, via control lines.

Also with the air-conditioning apparatus of the individual-operation multiple type according to Modification 2, effects similar to those obtained with the air-conditioning apparatus of the simultaneous-operation multiple type illustrated in FIGS. 1 to 3 can be achieved. That is, for example, when leakage of refrigerant occurs in the indoor unit 1A among the plurality of indoor units 1A, 1B, and 1C that are installed in an indoor space, the refrigerant detection unit 99A of the indoor unit 1A detects the leakage of refrigerant. Information indicating that the leakage of refrigerant has occurred in the indoor unit 1A is transmitted from the indoor unit control unit 31A to the other indoor unit control units 31B and 31C, the outdoor unit control unit 32, and the remote controller control units 33A, 33B, and 33C via control lines. Accordingly, the information indicating that the leakage of refrigerant has occurred in the indoor unit 1A may be shared not only with the indoor unit control unit 31A but also with the other indoor unit control units 31B and 31C, the outdoor unit control unit 32, and the remote controller control units 33A, 33B, and 33C. The indoor unit control units 31A, 31B, and 31C perform control such that the indoor air-sending fans 9A, 9B, and 9C are forcedly operated in accordance with the information.

Accordingly, even in the case where the floor area of an indoor space is large, refrigerant that has leaked can be sufficiently diffused into the indoor space. Therefore, even if leakage of refrigerant occurs, a situation in which the density of refrigerant in the indoor space is locally increased can be prevented. As a result, the density of refrigerant in the indoor space can be prevented from increasing to an allowable value or more. In addition, even in the case where a flammable refrigerant is used, a flammable density region is prevented from being formed in the indoor space.

Furthermore, when leakage of refrigerant occurs in any one of the indoor units 1A, 1B, and 1C, the indoor air-sending fans of all the indoor units start to operate. Accordingly, a sudden operation starting action, which is different from a normal action, is performed in each of the indoor units. Therefore, more people can be informed of a situation in which abnormality such as leakage of refrigerant has occurred. Consequently, a response such as opening a window or other actions can be performed more reliably.

(Modification 3)

Figure 7:
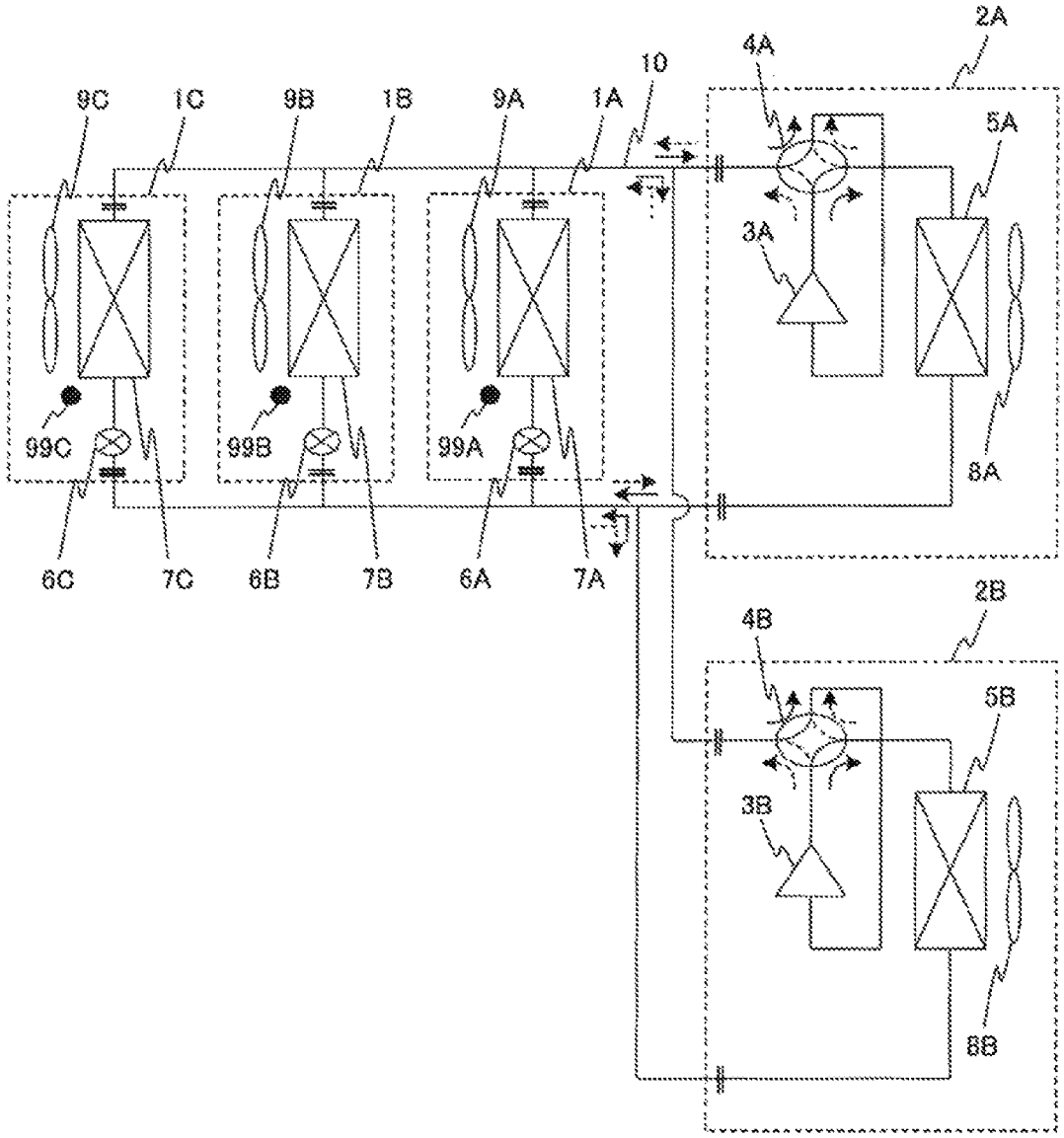
FIG. 7 is a refrigerant circuit diagram illustrating a schematic configuration of an air-conditioning apparatus according to Modification 3 of Embodiment 1 of the present invention.

FIG. 7 is a refrigerant circuit diagram illustrating a schematic configuration of an air-conditioning apparatus according to Modification 3 of Embodiment 1. As illustrated in FIG. 7, the air-conditioning apparatus according to Modification 3 is different from Modification 2 in that the air-conditioning apparatus includes the plurality of outdoor units 2A and 2B. The outdoor units 2A and 2B are provided in parallel to each other in the refrigeration cycle circuit 10. The compressor 3A, the refrigerant flow switching unit 4A, the heat-source-side heat exchanger 5A, and the outdoor air-sending fan 8A are accommodated in the outdoor unit 2A. The compressor 3B, the refrigerant flow switching unit 4B, the heat-source-side heat exchanger 5B, and the outdoor air-sending fan 8B are accommodated in the outdoor unit 2B. Although illustration is omitted, an outdoor unit control unit provided in each of the outdoor units 2A and 2B is connected to the indoor unit control units 31A, 31B, and 31C and the remote controller control units 33A, 33B, and 33C such that the outdoor unit control unit can communicate with the indoor unit control units 31A, 31B, and 31C and the remote controller control units 33A, 33B, and 330. The other configurations are similar to those in Modification 2. Also in Modification 3, effects similar to those obtained with the configurations illustrated in FIGS. 1 to 3 can be achieved.

(Modification 4)

Figure 8:
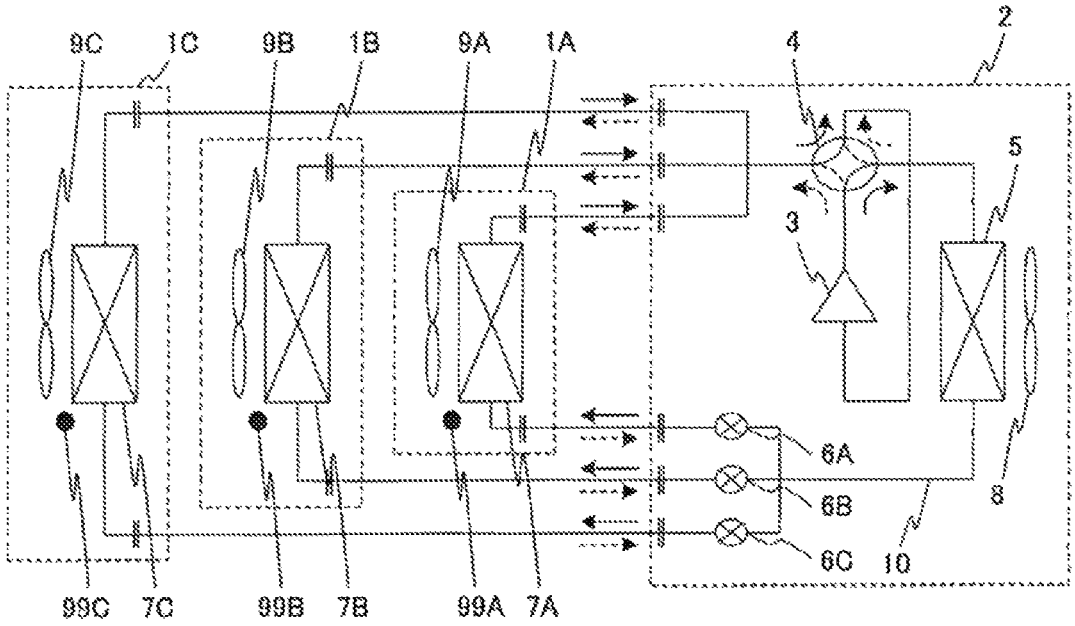
FIG. 8 is a refrigerant circuit diagram illustrating a schematic configuration of an air-conditioning apparatus according to Modification 4 of Embodiment 1 of the present invention.

FIG. 8 is a refrigerant circuit diagram illustrating a schematic configuration of an air-conditioning apparatus according to Modification 4 of Embodiment 1. As illustrated in FIG. 8, the air-conditioning apparatus according to Modification 4 is different from Modification 2 in that the pressure-reducing units 6A, 6B, and 6C whose number corresponds to the number of the indoor units 1A, 1B, and 1C are accommodated in the outdoor unit 2. The other configurations are similar to those in Modification 2. Also in Modification 4, effects similar to those obtained with the configurations illustrated in FIGS. 1 to 3 can be achieved.

(Modification 5)

Figure 9:
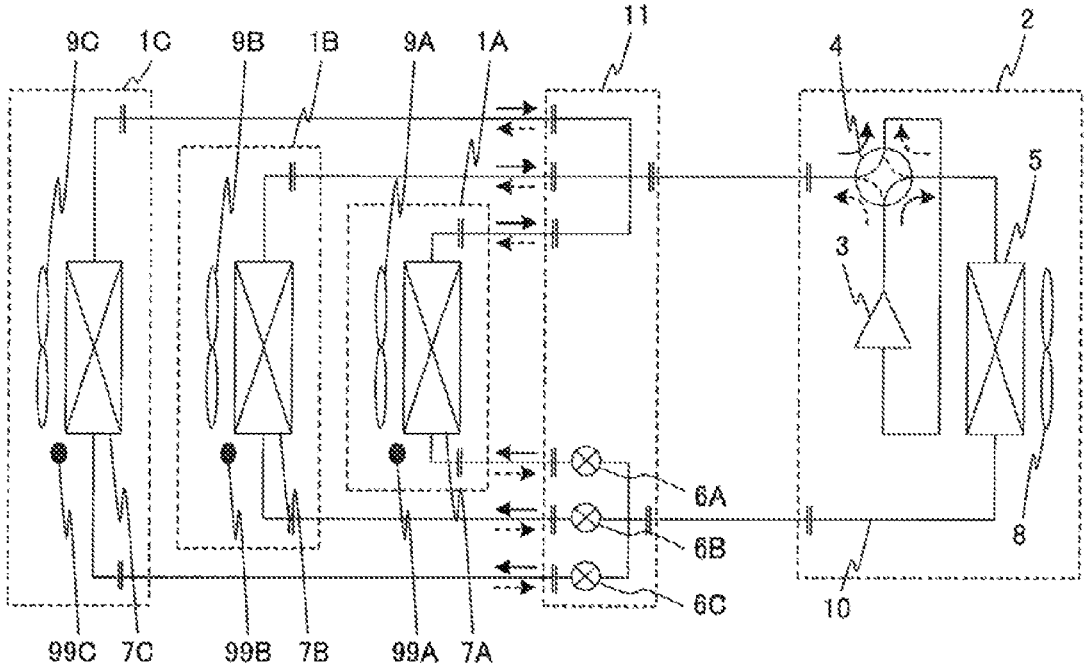
FIG. 9 is a refrigerant circuit diagram illustrating a schematic configuration of an air-conditioning apparatus according to Modification 5 of Embodiment 1 of the present invention.

FIG. 9 is a refrigerant circuit diagram illustrating a schematic configuration of an air-conditioning apparatus according to Modification 5 of Embodiment 1. As illustrated in FIG. 9, the air-conditioning apparatus according to Modification 5 is different from Modification 2 in that a branching unit 11 that is interposed between each of the indoor units 1A, 1B, and 1C and the outdoor unit 2 is provided in the refrigeration cycle circuit 10. The branching unit 11 is arranged in, for example, a space above the ceiling or other spaces, which is inside a building but is different from an indoor space. In the branching unit 11, a refrigerant pipe from the outdoor unit 2 branches out in a manner corresponding to the indoor units 1A, 1B, and 1C. Furthermore, the pressure-reducing units 6A, 6B, and 6C whose number corresponds to the number of the indoor units 1A, 1B, and 1C are accommodated in the branching unit 11. Although illustration is omitted, the branching unit 11 may include a controller that controls the pressure-reducing units 6A, 6B, and 6C. The controller is connected to the indoor unit control units 31A, 31B, and 31C, the outdoor unit control unit 32, and the remote controller control units 33A, 33B, and 33C such that the controller can communicate with the indoor unit control units 31A, 31B, and 31C, the outdoor unit control unit 32, and the remote controller control units 33A, 33B, and 33C. The other configurations are similar to those in Modification 2. Also in Modification 5, effects similar to those obtained with the configurations illustrated in FIGS. 1 to 3 can be achieved.

(Modification 6)

Figure 10:
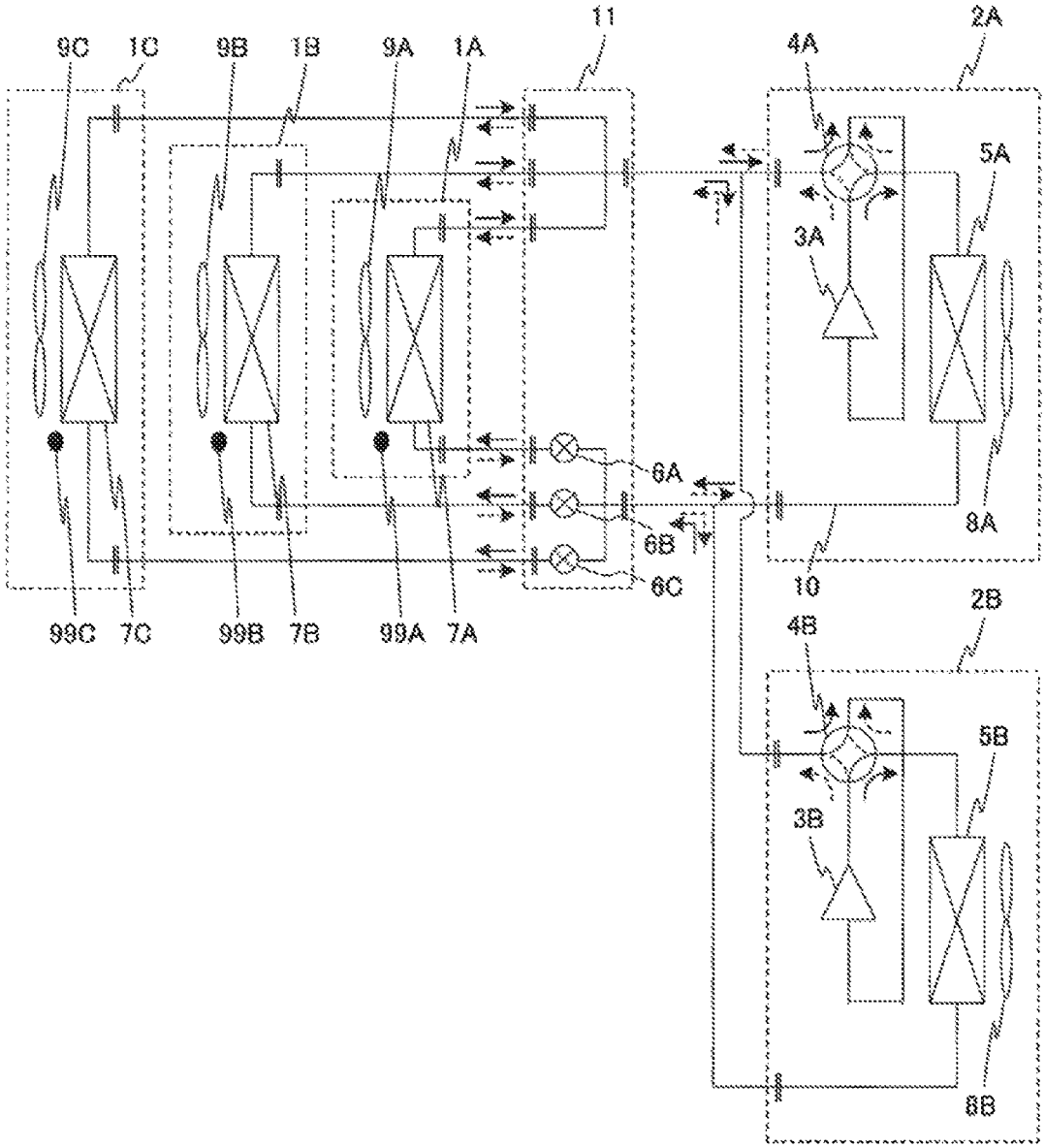
FIG. 10 is a refrigerant circuit diagram illustrating a schematic configuration of an air-conditioning apparatus according to Modification 6 of Embodiment 1 of the present invention.

FIG. 10 is a refrigerant circuit diagram illustrating a schematic configuration of an air-conditioning apparatus according to Modification 6 of Embodiment 1. As illustrated in FIG. 10, the air-conditioning apparatus according to Modification 6 is different from Modification 5 in that the air-conditioning apparatus includes the plurality of outdoor units 2A and 2B. The other configurations are similar to those in Modification 5. Also in Modification 6, effects similar to those obtained with the configurations illustrated in FIGS. 1 to 3 can be achieved.

(Modification 7)

Figure 11:
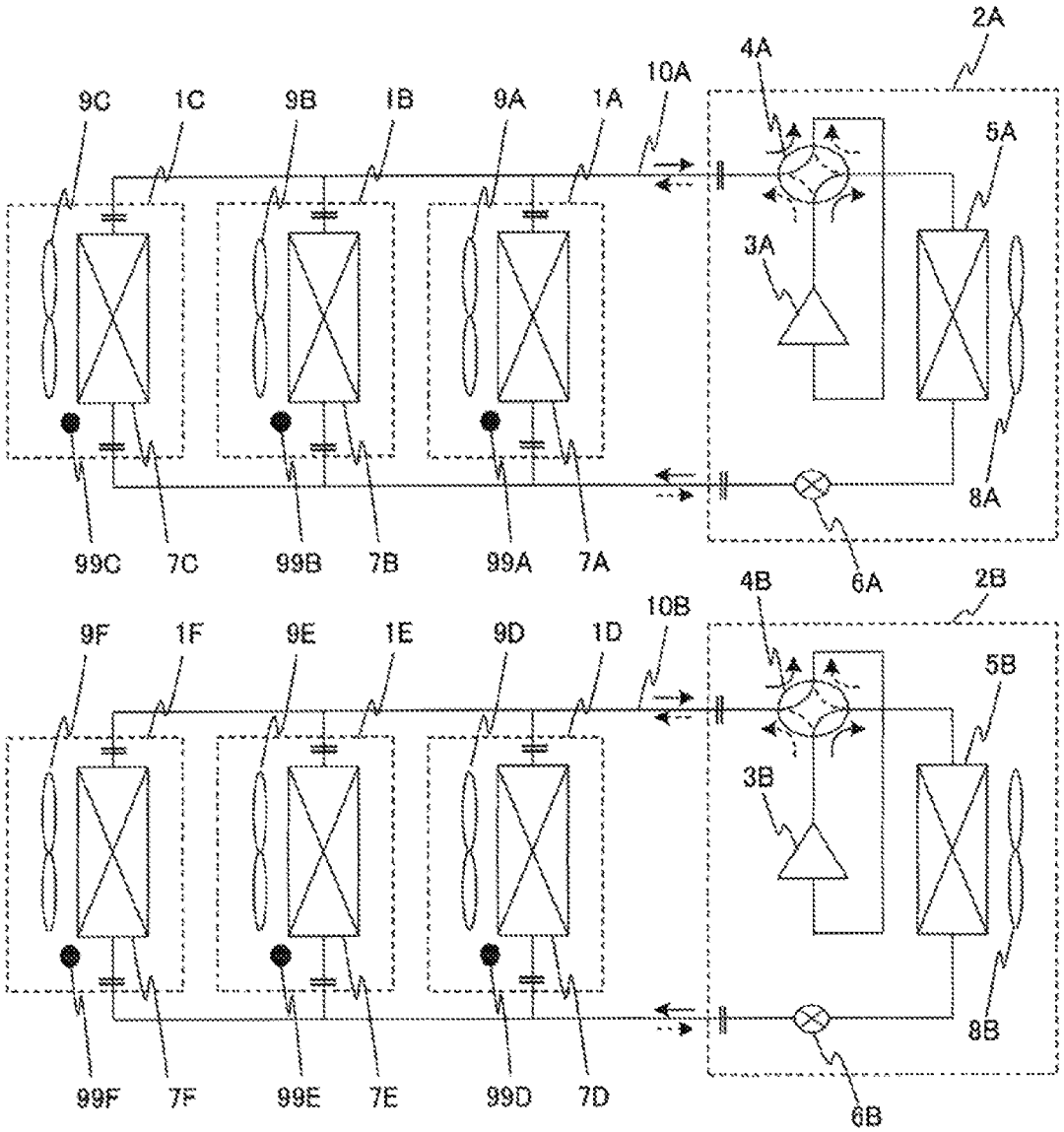
FIG. 11 is a refrigerant circuit diagram illustrating a schematic configuration of an air-conditioning apparatus according to Modification 7 of Embodiment 1 of the present invention.

FIG. 11 is a refrigerant circuit diagram illustrating a schematic configuration of an air-conditioning apparatus according to Modification 7 of Embodiment 1. As illustrated in FIG. 11, the air-conditioning apparatus according to Modification 7 includes a plurality of refrigeration cycle circuits 10A and 10B. Same refrigerant or different refrigerants are filled in the refrigeration cycle circuits 10A and 10B.

The refrigeration cycle circuit 10A has a configuration in which the compressor 3A, the refrigerant flow switching unit 4A, the heat-source-side heat exchanger 5A, the pressure-reducing unit 6A, and the plurality of load-side heat exchangers 7A, 7B, and 7C are connected by refrigerant pipes in a ring shape. The load-side heat exchangers 7A, 7B, and 70 are connected in parallel to one another in the refrigeration cycle circuit 10A. The compressor 3A, the refrigerant flow switching unit 4A, the heat-source-side heat exchanger 5A, the pressure-reducing unit 6A, and the outdoor air-sending fan 8A that supplies outdoor air to the heat-source-side heat exchanger 5A are accommodated in the outdoor unit 2A. The load-side heat exchangers 7A, 7B, and 7C, the indoor air-sending fans 9A, 9B, and 9C that supply air to the load-side heat exchangers 7A, 7B, and 7C, and the refrigerant detection units 99A, 99B, and 99C that detect leakage of refrigerant are accommodated in the indoor units 1A, 1B, and 1C, respectively.

The refrigeration cycle circuit 10B has a configuration in which the compressor 3B, the refrigerant flow switching unit 4B, the heat-source-side heat exchanger 5B, the pressure-reducing unit 6B, and a plurality of load-side heat exchangers 7D, 7E, and 7F are connected by refrigerant pipes in a ring shape. The load-side heat exchangers 7D, 7E, and 7F are connected in parallel to one another in the refrigeration cycle circuit 10B. The compressor 3B, the refrigerant flow switching unit 4B, the heat-source-side heat exchanger 5B, the pressure-reducing unit 6B, and the outdoor air-sending fan 8B that supplies outdoor air to the heat-source-side heat exchanger 5B are accommodated in the outdoor unit 2B. The load-side heat exchangers 7D, 7E, and 7F, indoor air-sending fans 9D, 9E, and 9F that supply air to the load-side heat exchangers 7D, 7E, and 7F, and refrigerant detection units 99D, 99E, and 99F that detect leakage of refrigerant are accommodated in indoor units 1D, 1E, and 1F, respectively.

The indoor units 1A, 1B, 1C, 1D, 1E, and 1F are installed in, for example, an indoor space with no partitions.

Figure 12:
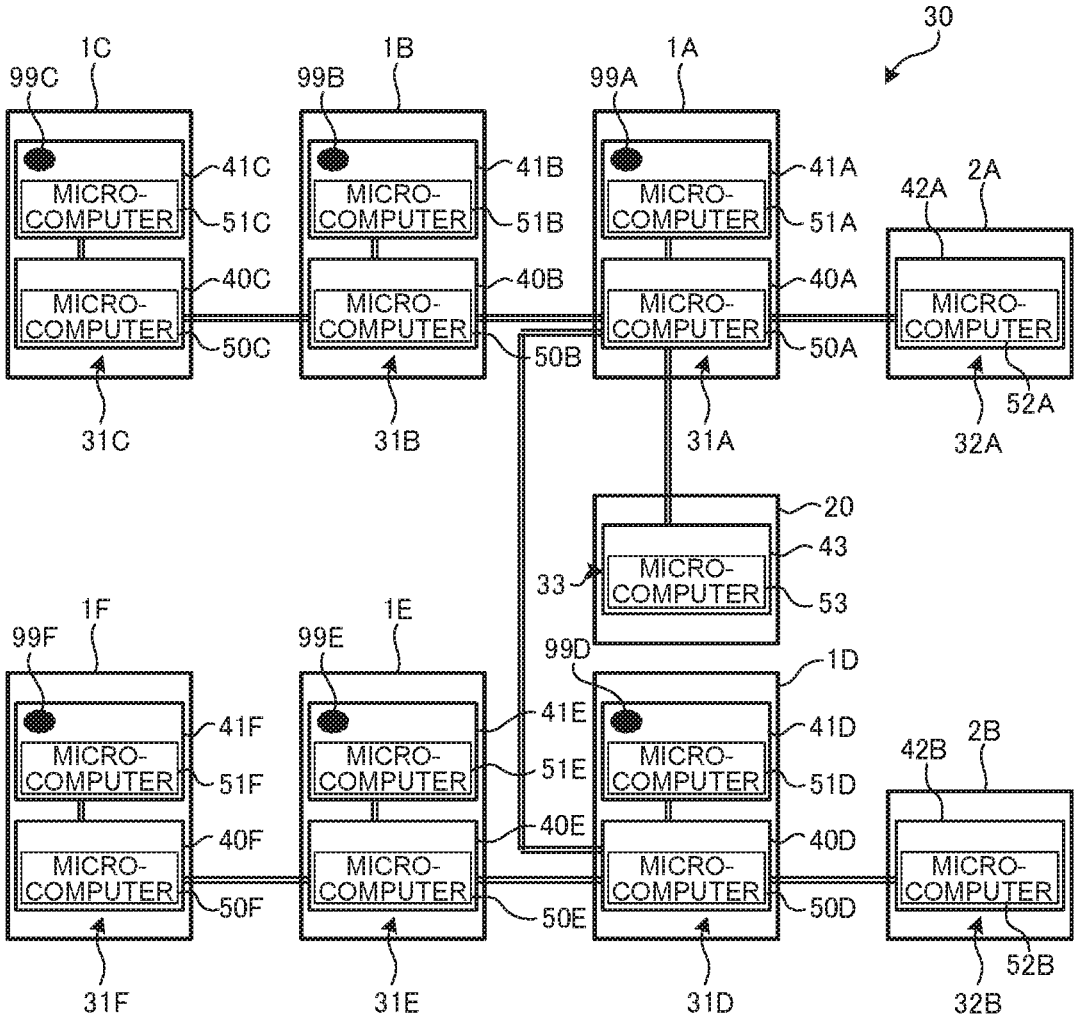
FIG. 12 is a block diagram illustrating a configuration of a controller 30 of the air-conditioning apparatus according to Modification 7 of Embodiment 1 of the present invention.

FIG. 12 is a block diagram illustrating a configuration of the controller 30 of the air-conditioning apparatus according to Modification 7. As illustrated in FIG. 12, in Modification 7, the indoor units 1A, 1B, and 1C that are connected to the refrigeration cycle circuit 10A and the indoor units 1D, 1E, and 1F that are connected to the refrigeration cycle circuit 10B are operated using the single remote controller 20. That is, the indoor units 1A, 1B, and 1C and the outdoor unit 2A, and the indoor units 1D, 1E, and 1F and the outdoor unit 2B, configure a single air-conditioning apparatus of a simultaneous-operation multiple type.

The controller 30 includes the indoor unit control unit 31A that is mounted in the indoor unit 1A and controls the indoor unit 1A, the indoor unit control unit 31B that is mounted in the indoor unit 1B and controls the indoor unit 1B, the indoor unit control unit 31C that is mounted in the indoor unit 1C and controls the indoor unit 1C, an outdoor unit control unit 32A that is mounted in the outdoor unit 2A and controls the outdoor unit 2A, an indoor unit control unit 31D that is mounted in the indoor unit 1D and controls the indoor unit 1D, an indoor unit control unit 31E that is mounted in the indoor unit 1E and controls the indoor unit 1E, an indoor unit control unit 31F that is mounted in the indoor unit 1F and controls the indoor unit 1F, an outdoor unit control unit 32B that is mounted in the outdoor unit 2B and controls the outdoor unit 2B, and the remote controller control unit 33 that is mounted in the remote controller 20 and controls the remote controller 20.

The indoor unit control unit 31A includes the control substrate 40A on which the microcomputer 50A is mounted and the control substrate 41A on which the microcomputer 51A and the refrigerant detection unit 99A are mounted. In a similar manner, the indoor unit control units 31B, 31C, 31D, 31E, and 31F include the control substrates 40B, 40C, 40D, 40E, and 40F on which the microcomputers 50B, 50C, 50D, 50E, and 50F are mounted, and the control substrates 41B, 41C, 41D, 41E, and 41F on which the microcomputers 50B, 50C, 50D, 50E, and 50F and the refrigerant detection units 99B, 99C, 99D, 99E, and 99F are mounted, respectively.

The microcomputers 51A, 51B, 51C, 51D, 51E, and 51F each include a rewritable nonvolatile memory. The nonvolatile memory includes a leakage history bit (an example of a leakage history memory region), as explained above.

The outdoor unit control unit 32A includes a control substrate 42A on which a microcomputer 52A is mounted. The outdoor unit control unit 32B includes a control substrate 42B on which a microcomputer 52B is mounted.

The remote controller control unit 33 includes the control substrate 43 on which the microcomputer 53 is mounted.

The indoor unit control units 31A, 31B, 31C, 31D, 31E, and 31F, the outdoor unit control units 32A and 32B and the remote controller control unit 33 are connected such that they can communicate with one another via control lines.

When the refrigerant detection unit 99A detects leakage of refrigerant, the leakage history bit of the microcomputer 51A is rewritten from "0" to "1". In a similar manner, when the refrigerant detection units 99B, 99C, 99D, 99E, and 99F detect leakage of refrigerant, the leakage history bits of the microcomputers 51B, 51C, 51D, 51E, and 51F are rewritten from "0" to "1". The leakage history bits of all the microcomputers 51A, 51B, 51C, 51D, 51E, and 51F are irreversibly rewritable only in one direction from "0" to "1". Furthermore, the leakage history bits of all the microcomputers 51A, 51B, 51C, 51D, 51E, and 51F are maintained without depending on whether or not power is supplied to the microcomputers 51A, 51B, 51C, 51D, 51E, and 51F.

A first leakage history bit corresponding to the leakage history bit of the microcomputer 51A, a second leakage history bit corresponding to the leakage history bit of the microcomputer 51B, a third leakage history bit corresponding to the leakage history bit of the microcomputer 51C, a fourth leakage history bit corresponding to the leakage history bit of the microcomputer 51D, a fifth leakage history bit corresponding to the leakage history bit of the microcomputer 51E, and a sixth leakage history bit corresponding to the leakage history bit of the microcomputer 51F are provided in the memories (nonvolatile memories or volatile memories) of the microcomputers 50A, 50B, 50C, 50E, 50D, 50F, 52A, 52B, and 53. The first to sixth leakage history bits of the microcomputers 50A, 50B, 50C, 50E, 50D, 50F, 52A, 52B, and 53 can be set to "0" or "1" and are bidirectionally rewritable between "0" and "1". The value of the first leakage history bit of each of the microcomputers 50A, 50B, 50C, 50E, 50D, 50F, 52A, 52B, and 53 is set to the same value as the leakage history bit of the microcomputer 51A acquired by communication. In a similar manner, the values of the second to sixth leakage history bits of the microcomputers 50A, 50B, 50C, 50E, 50D, 50F, 52A, 52B, and 53 are set to the same values as the leakage history bits of the microcomputers 51B, 51C, 51D, 51E, and 51F acquired by communication. Even if power supply is interrupted and the values of the first to sixth leakage history bits of the microcomputers 50A, 50B, 50C, 50E, 50D, 50F, 52A, 52B, and 53 are returned to the initial value (for example, "0"), once power supply resumes, the first to sixth leakage history bits of the microcomputers 50A, 50B, 50C, 50E, 50D, 50F, 52A, 52B, and 53 are set to the same values as the leakage history bits of the microcomputers 51A, 51B, 51C, 51D, 51E, and 51F.

When all the first to sixth leakage history bits of the microcomputer 50A are set to "0", the indoor unit control unit 31A performs normal control for the indoor unit 1A. The indoor unit 1A in this state performs normal operating action and stopping actions based on an operation of the remote controller 20 or other devices. In contrast, when any one of the first to sixth leakage history bits of the microcomputer 50A is set to "1", the indoor unit control unit 31A performs control such that the indoor air-sending fan 9A is forcedly operated. That is, the operation of the indoor air-sending fan 9A is continued while the indoor unit 1A is operating, whereas the operation of the indoor air-sending fan 9A is started when the indoor unit 1A is stopped.

Each of the indoor unit control units 31B, 31C, 31D, 31E, and 31F performs control similar to that of the indoor unit control unit 31A, based on the values of the first to sixth leakage history bits.

When all the first to sixth leakage history bits of the microcomputer 52A are set to "0", the outdoor unit control unit 32A performs normal control for the outdoor unit 2A. In contrast, when any one of the first to sixth leakage history bits of the microcomputer 52A is set to "1", the outdoor unit control unit 32A performs, for example, control for stopping the compressor 3A or control for inhibiting operation of the compressor 3A. The above-mentioned control is continued as long as any one of the first to sixth leakage history bits of the microcomputer 52A is set to "1".

The outdoor unit control unit 32B performs control similar to that of the outdoor unit control unit 32A, based on the values of the first to sixth leakage history bits.

When all the first to sixth leakage history bits of the microcomputer 53 are set to "0", the remote controller control unit 33 performs normal control for the remote controller 20. In contrast, when any one of the first to sixth leakage history bits of the microcomputer 53 is set to "1", for example, the remote controller control unit 33 displays information including a type of abnormality or a treatment method (for example, a character message such as "Refrigerant is leaking. Please contact a service person.", abnormality code, or other types of information) on the display unit provided at the remote controller 20. At this time, the remote controller control unit 33 may display information of a position where leakage of refrigerant has occurred on the display unit, according to which one of the first to sixth leakage history bits the value "1" is set to. The above-mentioned display is continued as long as any one of the first to sixth leakage history bits of the microcomputer 53 is set to "1". Furthermore, the remote controller control unit 33 may cause a sound output unit provided at the remote controller 20 to output, by sound, information including a type of abnormality, a treatment method, or a position where leakage of refrigerant has occurred.

With this configuration, for example, when leakage of refrigerant occurs in the indoor unit 1A, the refrigerant detection unit 99A of the indoor unit 1A detects the leakage of refrigerant. When the leakage of refrigerant is detected by the refrigerant detection unit 99A, the microcomputer 51A irreversibly rewrites the leakage history bit from the initial value "0" to "1". When the leakage history bit of the microcomputer 51A is set to "1", the first leakage history bit of each of the microcomputers 50A, 50B, 50C, 50D, 50E, 50F, 52A, 52B, and 53 is also rewritten from "0" to "1". Accordingly, forced operation of all the indoor air-sending fans 9A, 9B, 9C 9D, 9E, and 9F, stopping of the compressors 3A and 3B, inhibition of operation of the compressors 3A and 3B, display of information on the display unit of the remote controller 20, and other types of processing are performed.

When a service person is contacted by a user, he or she fixes the position where leakage of refrigerant has occurred by replacing the control substrate 41A at which leakage of refrigerant has been detected with a brand-new one. This is because the leakage history bit of the microcomputer 51A is maintained at "1" when the position where the leakage of refrigerant has occurred is simply fixed, and therefore, the air-conditioning apparatus cannot perform a normal action. The refrigerant detection unit 99A is non-detachably connected to the control substrate 41A. Therefore, when the control substrate 41A is replaced, the refrigerant detection unit 99A is also replaced at the same time.

The leakage history bit of the microcomputer 51A mounted on the new control substrate 41A is set to the initial value "0". Therefore, the first leakage history bit of each of the microcomputers 50A, 50B, 50C, 50D, 50E, 50F, 52A, 52B, and 53 is also rewritten from "1" to "0". Accordingly, the air-conditioning apparatus can perform a normal action.

In Modification 7, when leakage of refrigerant occurs in any one of the plurality of indoor units 1A, 1B, 1C, 1D, 1E, and 1F, not only the indoor air-sending fan of the indoor unit in which the leakage of refrigerant has occurred but also the indoor air-sending fans of all the indoor units can be operated. Accordingly, even in the case where the floor area of an indoor space is large, refrigerant that has leaked can be sufficiently diffused into the indoor space. Therefore, even if leakage of refrigerant occurs, a situation in which the density of refrigerant in the indoor space is locally increased can be prevented. As a result, the density of refrigerant in the indoor space can be prevented from increasing to an allowable value or more. In addition, even in the case where a flammable refrigerant is used, a flammable density region is prevented from being formed in the indoor space.

Furthermore, in Modification 7, when leakage of refrigerant occurs in any one of the indoor units 1A, 1B, 1C, 1D, 1E, and 1F, the indoor air-sending fans of all the indoor units start to operate. Accordingly, a sudden operation starting action, which is different from a normal action, is performed in each of the indoor units. Therefore, more people can be informed of a situation in which abnormality such as leakage of refrigerant has occurred. Consequently, a response such as opening a window or other actions can be performed more reliably.

(Modification 8)

Figure 13:
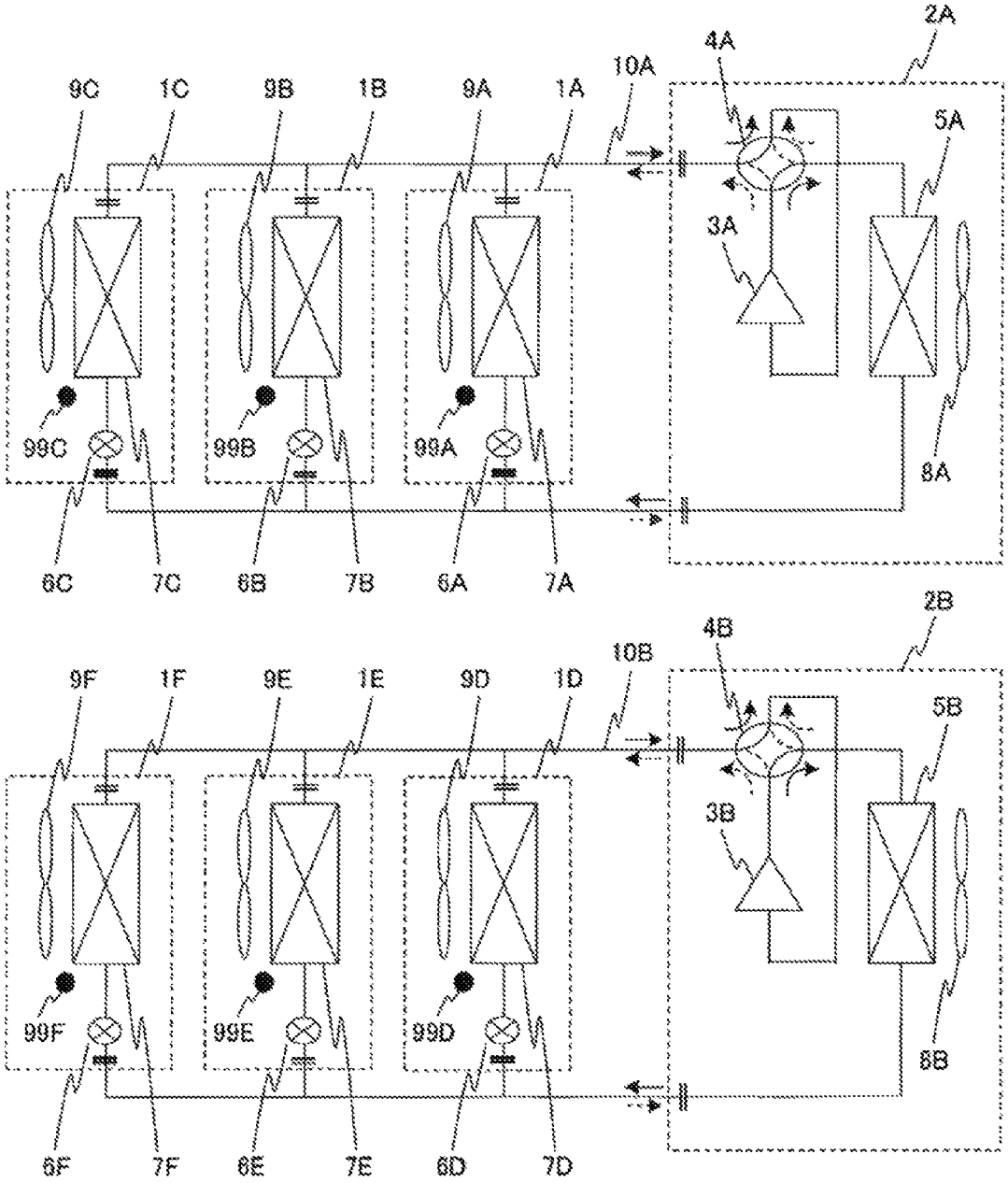
FIG. 13 is a refrigerant circuit diagram illustrating a schematic configuration of an air-conditioning apparatus according to Modification 8 of Embodiment 1 of the present invention.

FIG. 13 is a refrigerant circuit diagram illustrating a schematic configuration of an air-conditioning apparatus according to Modification 8 of Embodiment 1. As illustrated in FIG. 13, the air-conditioning apparatus according to Modification 8 includes pressure-reducing units 6A, 6B, 6C, 6D, 6E, and 6F corresponding to the indoor units 1A, 1B, 1C, 1D, 1E, and 1F, respectively. The pressure-reducing units 6A, 6B, 6C, 60, 6E, and 6F are accommodated in the indoor units 1A, 1B, 1C, 1D, 1E, and 1F, respectively. The indoor units 1A, 1B, 1C, 1D, 1E, and 1F are installed in, for example, an indoor space with no partitions.

Figure 14:
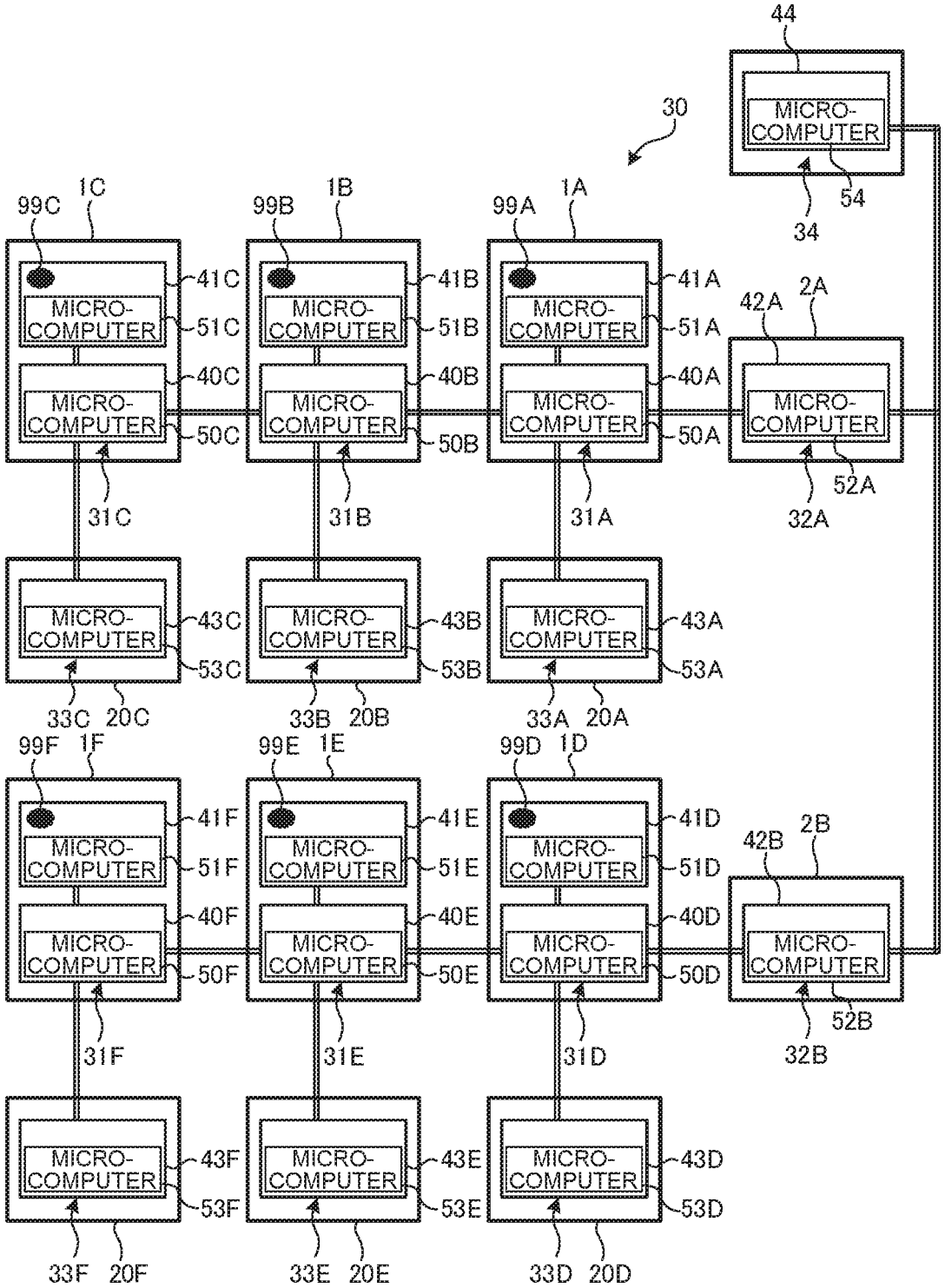
FIG. 14 is a block diagram illustrating a configuration of a controller 30 of the air-conditioning apparatus according to Modification 8 of Embodiment 1 of the present invention.

FIG. 14 is a block diagram illustrating a configuration of the controller 30 of the air-conditioning apparatus according to Modification 8. As illustrated in FIG. 14, in Modification 8, the indoor units 1A, 1B, and 1C that are connected to the refrigeration cycle circuit 10A and the indoor units 1D, 1E, and 1F that are connected to the refrigeration cycle circuit 10B are operated using the remote controllers 20A, 20B, 20C, 20D, 20E, and 20F, respectively.

The controller 30 includes the remote controller control unit 33A that is mounted in the remote controller 20A and controls the remote controller 20A, the remote controller control unit 33B that is mounted in the remote controller 20B and controls the remote controller 20B, the remote controller control unit 33C that is mounted in the remote controller 200 and controls the remote controller 20C, a remote controller control unit 330 that is mounted in a remote controller 200 and controls the remote controller 20D, a remote controller control unit 33E that is mounted in a remote controller 20E and controls the remote controller 20E, and a remote controller control unit 33F that is mounted in a remote controller 20F and controls the remote controller 20F, in addition to the indoor unit control units 31A, 31B, 31C, 31D, 31E, and 31F and the outdoor unit control units 32A and 32B.

The remote controller control unit 33A includes the control substrate 43A on which the microcomputer 53A is mounted. In a similar manner, the remote controller control units 33B, 33C, 330, 33E, and 33F include control substrates 43B, 43C, 43D, 43E, and 43F on which microcomputers 53B, 53C, 53D, 53E, and 53F are mounted, respectively.

Furthermore, the indoor unit control units 31A, 31B, 31C, 31D, 31E, and 31F, the outdoor unit control units 32A and 32B, and the remote controller control units 33A, 33B, 33C, 33D, 33E, and 33F are connected to a host control unit 34. The host control unit 34 includes a control substrate 44 on which a microcomputer 54 is mounted. The host control unit 34 functions as a centralized controller that manages the indoor units 1A, 1B, 1C, 1D, 1E, and 1F in a centralized manner. That is, the indoor units 1A, 1B, and 1C and the outdoor unit 2A, and the indoor units 1D, 1E, and 1F and the outdoor unit 2B, configure a single air-conditioning apparatus of an individual-operation multiple type.

As with the microcomputers 50A, 50B, 50C, 50E, 50D, 50F, 52A, and 52B, a memory of each of the microcomputers 53A, 53B, 53C, 53D, 53E, 53F, and 54 includes a first leakage history bit corresponding to the leakage history bit of the microcomputer 51A, a second leakage history bit corresponding to the leakage history bit of the microcomputer 51B, a third leakage history bit corresponding to the leakage history bit of the microcomputer 51C, a fourth leakage history bit corresponding to the leakage history bit of the microcomputer 51D, a fifth leakage history bit corresponding to the leakage history bit of the microcomputer 51E, and a sixth leakage history bit corresponding to the leakage history bit of the microcomputer 51F.

Also in Modification 8, when leakage of refrigerant occurs in any one of the plurality of indoor units 1A, 1B, 1C, 1D, 1E, an 1F, not only the indoor air-sending fan of the indoor unit in which the leakage of refrigerant has occurred but also the indoor air-sending fans of all the indoor units can be operated. Accordingly, even in the case where the floor area of an indoor space is large, refrigerant that has leaked can be sufficiently diffused into the indoor space. Therefore, even if leakage of refrigerant occurs, a situation in which the density of refrigerant in the indoor space is locally increased can be prevented. As a result, the density of refrigerant in the indoor space can be prevented from increasing to an allowable value or more. In addition, even in the case where a flammable refrigerant is used, a flammable density region is prevented from being formed in the indoor space.

Furthermore, also in Modification 8, when leakage of refrigerant occurs in any one of the indoor units 1A, 1B, 1C, 1D, 1E, and 1F, the indoor air-sending fans of all the indoor units start to operate. Accordingly, a sudden operation starting action, which is different from a normal action, is performed in each of the indoor units. Therefore, more people can be informed of a situation in which abnormality such as leakage of refrigerant has occurred. Consequently, a response such as opening a window or other actions can be performed more reliably.

(Modification 9)

Figure 15:
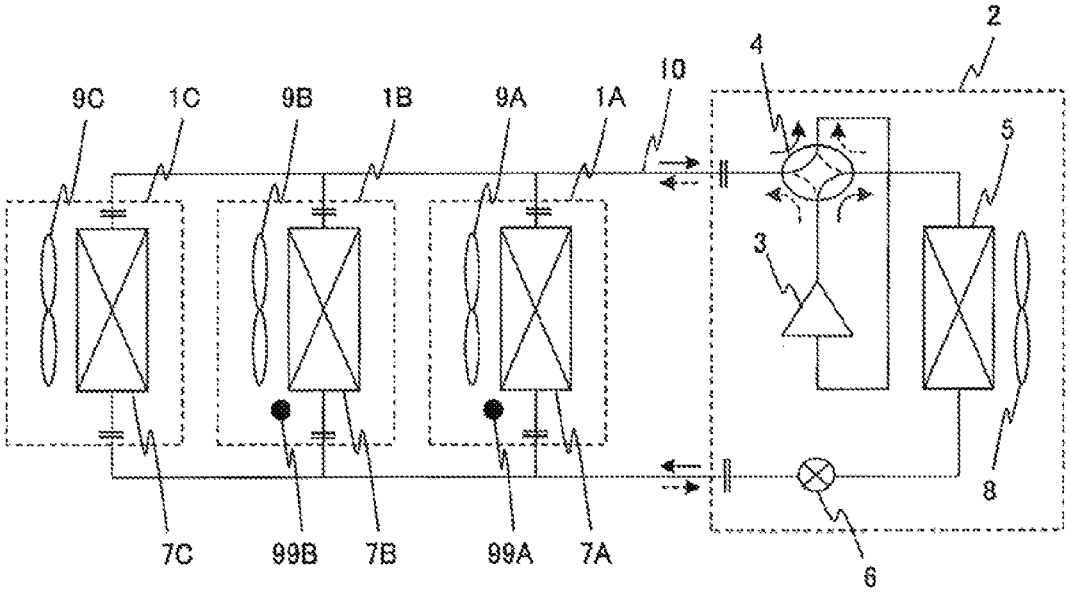
FIG. 15 is a refrigerant circuit diagram illustrating a schematic configuration of an air-conditioning apparatus according to Modification 9 of Embodiment 1 of the present invention.
Figure 16:
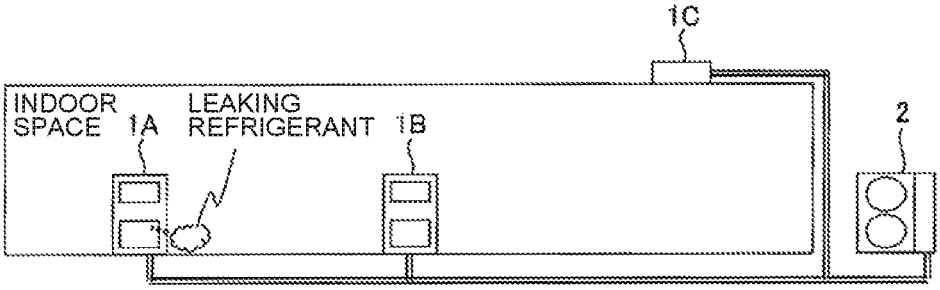
FIG. 16 is a diagram illustrating an example of a state in which indoor units 1A, 1B, and 1C are installed in the air-conditioning apparatus according to Modification 9 of Embodiment 1 of the present invention.

FIG. 15 is a refrigerant circuit diagram illustrating a schematic configuration of an air-conditioning apparatus according to Modification 9 of Embodiment 1. FIG. 16 is a diagram illustrating an example of a state in which the indoor units 1A, 1B, and 1C are installed in the air-conditioning apparatus according to Modification 9. As illustrated in FIGS. 15 and 16, the air-conditioning apparatus according to Modification 9 includes the indoor units 1A and 1B of a wall type and the indoor unit 1C of a ceiling cassette type. The indoor units 1A and 1B of the wall type include the refrigerant detection units 99A and 99B, respectively. The indoor unit 1C of the ceiling cassette type does not include a refrigerant detection unit.

With this configuration, when leakage of refrigerant occurs in the indoor unit 1A of the wall type, as illustrated in FIG. 16, the refrigerant detection unit 99A of the indoor unit 1A detects the leakage of refrigerant. Information indicating that the leakage of refrigerant has occurred in the indoor unit 1A is shared not only with the controller of the indoor unit 1A but also with the controllers of the indoor units 1B, 1C, and other indoor units. Accordingly, the indoor air-sending fans 9A, 9B, and 9C of all the indoor units 1A, 1B, and 1C including the indoor unit 1C of the ceiling cassette type operate. In a similar manner, when leakage of refrigerant occurs in the indoor unit 1B, the indoor air-sending fans 9A, 9B, and 9C of all the indoor units 1A, 1B, and 1C operate.

In contrast, when leakage of refrigerant occurs in the indoor unit 1C of the ceiling cassette type, the indoor unit 1C does not detect the leakage of refrigerant. Therefore, the indoor air-sending fans 9A, 9B, and 9C do not necessarily operate. However, because the indoor unit 1C of the ceiling cassette type is installed at a relatively high position from the floor, even if leakage of refrigerant occurs in the indoor unit 1C, refrigerant that has leaked is diffused before dropping to the floor, Therefore, without requiring operation of the indoor air-sending fans 9A, 9B, and 9C, a situation in which the density of refrigerant is locally increased can be prevented. As a result, the density of refrigerant in the indoor space can be prevented from increasing to an allowable value or more. In addition, even in the case where a flammable refrigerant is used, a flammable density region is prevented from being formed in the indoor space.

That is, as in Modification 9, in the case where an indoor unit of the wall type and an indoor unit of the ceiling cassette type, the ceiling concealed type, the ceiling suspended type, or other types that is installed at a position relatively high from the floor coexist, the indoor unit of the ceiling cassette type, the ceiling concealed type, the ceiling suspended type, or other types may not include a refrigerant detection unit. Accordingly, the cost of the air-conditioning apparatus can be reduced while a situation in which the density of refrigerant in an indoor space is locally increased being prevented.

Summary of Embodiment

As described above, an air-conditioning apparatus (an example of a refrigeration cycle apparatus) according to Embodiment 1 (including Modifications 1 to 9) includes the refrigeration cycle circuit 10 including the plurality of load-side heat exchangers 7A, 7B, 7C, 7D, 7E, and 7F and the plurality of indoor units 1A, 1B, 1C, 1D, 1E, and 1F including the plurality of load-side heat exchangers 7A, 7B, 7C, 7D, 7E, and 7F, respectively. The plurality of indoor units 1A, 1B, 1C, 1D, 1E, and 1F include the indoor air-sending fans 9A, 9B, 9C, 9D, 9E, and 9F, respectively. At least one (for example, all) of the plurality of indoor units 1A, 1B, 1C, 1D, 1E, and 1F include the refrigerant detection units 99A, 99B, 99C, 99D, 99E, and 99F, respectively, that detect leakage of refrigerant. When leakage of refrigerant is detected by the refrigerant detection unit included in any one of the plurality of indoor units 1A, 1B, 1C, 1D, 1E, and 1F, the indoor air-sending fans 9A, 9B, 9C, 9D, 9E, and 9F included in all of the plurality of indoor units 1A, 1B, 1C, 1D, 1E, and 1F operate.

Furthermore, the air-conditioning apparatus according to Embodiment 1 includes the plurality of refrigeration cycle circuits 10A and 10B each including at least one load-side heat exchanger and the plurality of indoor units 1A, 1B, 1C, 1D, 1E, and 1F including the load-side heat exchangers 7A, 7B, 7C, 7D, 7E, and 7F, respectively, of the plurality of refrigeration cycle circuits 10A and 10B. The plurality of indoor units 1A, 1B, 1C, 1D, 1E, and 1F include the indoor air-sending fans 9A, 9B, 9C, 9D, 9E, and 9F, respectively. At least one (for example, all) of the plurality of indoor units 1A, 1B, 1C, 1D, 1E, and 1F include the refrigerant detection units 99A, 99B, 99C, 99D, 99E, an 99F, respectively, that detect leakage of refrigerant. When leakage of refrigerant is detected by the refrigerant detection unit included in any one of the plurality of indoor units 1A, 1B, 1C, 1D, 1E, and 1F, the indoor air-sending fans 9A, 9B, 9C, 9C, 9E, and 9F included in all of the plurality of indoor units 1A, 1B, 1C, 1D, 1E, and 1F operate.

With the above configuration, when leakage of refrigerant occurs in any one of the plurality of indoor units 1A, 1B, 1C, 1D, 1E, and 1F, not only the indoor air-sending fan of the indoor unit in which the leakage of refrigerant has occurred but also the indoor air-sending fans 9A, 9B, 9C, 9D, 9E, and 9F of all the indoor units 1A, 1B, 1C, 1D, 1E, and 1F can be operated. Accordingly, even in the case where the floor area of an indoor space is large, refrigerant that has leaked can be sufficiently diffused into the indoor space. Therefore, even if leakage of refrigerant occurs, a situation in which the density of refrigerant in the indoor space is locally increased can be prevented.

Furthermore, the air-conditioning apparatus according to Embodiment 1 may be configured to further include the controller 30 that controls the plurality of indoor units 1A, 1B, 1C, 1D, 1E, and 1F When leakage of refrigerant is detected by a refrigerant detection unit included in any one of the plurality of indoor units 1A, 1B, 1C, 1D, 1E, and 1F, the indoor air-sending fans 9A, 9B, 9C, 9D, 9E, and 9F included in all of the plurality of indoor units 1A, 1B, 1C, 1D, 1E, and 1F may be operated.

Furthermore, the air-conditioning apparatus according to Embodiment 1 may be configured such that the controller 30 includes the plurality of indoor unit control units 31A, 31B, 31C, 31D, 31E, and 31F that control the plurality of indoor units 1A, 1B, 1C, 1D, 1E, and 1F, respectively, at least one (for example, all) of the plurality of indoor unit control units 31A, 31B, 31C, 31D, 31E, and 31F includes the control substrates 41A, 41B, 41C, 41D, 41E, and 41F to which the refrigerant detection units 99A, 99B, 99C, 99D, 99E, and 99F are non-detachably connected and nonvolatile memories included in the control substrates 41A, 41B, 41C, 41D, 41E, and 41F, respectively, the nonvolatile memories each include a leakage history memory region that stores one of first information (for example, a leakage history bit of "0") indicating a state in which there is no refrigerant leakage history and second information (for example, a leakage history bit of "1") indicating a state in which there is a refrigerant leakage history, the information stored in the leakage history memory region can be changed in only one direction from the first information to the second information, and the controller 30 changes, when leakage of refrigerant is detected by a refrigerant detection unit included in any one of the plurality of indoor unit control units 31A, 31B, 31C, 31D, 31E, and 31F, the information stored in the leakage history memory region of the indoor unit control unit that has detected the leakage of refrigerant from the first information to the second information.

Furthermore, the air-conditioning apparatus according to Embodiment 1 may be configured such that the controller 30 causes, when information stored in a leakage history memory region of at least one of the plurality of indoor unit control units 31A, 31B, 31C, 31D, 31E, and 31F is changed from the first information to the second information, the indoor air-sending fans 9A, 9B, 9C, 9D, 9E, and 9F included in all of the plurality of indoor units 1A, 1B, 1C, 1D, 1E, and 1F to be operated.

Other Embodiments

The present invention is not limited to the foregoing embodiment, and various modifications may be made to the present invention.

For example, in the foregoing embodiment, leakage history bits are illustrated as examples of leakage history memory regions provided in the nonvolatile memories of the microcomputers 51A, 51B, 51C, 51D, 51E, and 51F. However, the present invention is not limited to this. For example, a leakage history memory region of two or more bits may be provided in a nonvolatile memory. A leakage history memory region selectively stores one of first information indicating a state in which there is no refrigerant leakage history and second information indicating a state in which there is a refrigerant leakage history. Furthermore, information stored in a leakage history memory region can be changed only in one direction from the first information to the second information. Information stored in the leakage history memory regions of the microcomputers 51A, 51B, 51C, 51D, 51E, and 51F is changed from the first information to the second information when leakage of refrigerant is detected by the refrigerant detection units 99A, 99B, 99C, 99D, 99E, and 99F, respectively. Furthermore, the first to sixth leakage history memory regions corresponding to the leakage history memory regions of the microcomputers 51A, 51B, 51C, 51D, 51E, and 51F are provided in the memories of the microcomputers 50A, 50B, 50C, 50D, 50E, 50F, 52, 53, and other units.

Furthermore, in the foregoing embodiment, an air-conditioning apparatus is described as an example of a refrigeration cycle apparatus. However, the present invention is also applicable to other kinds of refrigeration cycle apparatus such as a heat pump water heater (for example, a heat pump apparatus described in Japanese Unexamined Patent Application Publication No, 2016-3783), a chiller, a showcase, or other apparatuses.

Furthermore, in the foregoing embodiment, the refrigeration cycle circuits 10, 10A, and 10B to which three or six indoor units are connected are described as an example. However, any number of indoor units may be connected to the refrigeration cycle circuits 10, 10A, and 10B. Furthermore, in the foregoing embodiment, the refrigeration cycle circuits 10, 10A, and 10B to which one or two outdoor units are connected are described as an example. However, any number of outdoor units may be connected to the refrigeration cycle circuits 10, 10A, and 10B. Furthermore, in the foregoing embodiment, an air-conditioning apparatus including the refrigeration cycle circuit 10 or the two refrigeration cycle circuits 10A and 10B is described as an example. However, any number of refrigeration cycle circuits may be provided.

Furthermore, in the foregoing embodiment, a configuration in which a refrigerant detection unit is provided inside a housing of an indoor unit is described as an example. However, the refrigerant detection unit may be provided outside the housing of the indoor unit as long as the refrigerant detection unit is connected to a controller of the refrigeration cycle apparatus. For example, the refrigerant detection unit may be provided in an indoor space or may be provided near the floor of an indoor space by considering that refrigerant has a density higher than air. Furthermore, for example, in the case where two floor-type indoor units are provided, by providing a refrigerant detection unit near the floor between the two floor-type indoor units, leakage of refrigerant in both the floor-type indoor units can be detected. Furthermore, as described in Modification 9, in the case where an indoor unit of a floor type and an indoor unit of a ceiling cassette type, a ceiling concealed type, a ceiling suspended type, or other types coexist, the indoor unit of the ceiling cassette type, the ceiling concealed type, the ceiling suspended type, or other types may not include a refrigerant detection unit. Therefore, a refrigerant detection unit is not necessarily provided in all the indoor units.

Furthermore, in the foregoing embodiment, a configuration in which an indoor air-sending fan is provided inside a housing of an indoor unit is described as an example. However, an indoor air-sending fan may be provided outside the housing of an indoor unit as long as the indoor air-sending fan is connected to a controller of the refrigeration cycle apparatus.

Furthermore, in the foregoing embodiment, a refrigeration cycle apparatus including the controller 30 is described as an example. However, the controller 30 may be omitted by, for example, using a temperature sensor that mechanically operates based on temperature or other parameters as a refrigerant detection unit. For example, a temperature sensor outputs a contact signal when temperature drops to a predetermined degree or less due to leakage of refrigerant, so that an air-sending fan of an indoor unit in which the temperature sensor is mounted can be operated. Air-sending fans of a plurality of indoor units are connected to one another with a relay therebetween. When an air-sending fan of an indoor unit operates, air-sending fans of other indoor units operate in conjunction with the operating air-sending fan.

Furthermore, in the foregoing embodiment, a refrigeration cycle apparatus in which indoor air-sending fans included in all of a plurality of indoor units operate when leakage of refrigerant is detected by a refrigerant detection unit included in any one of the plurality of indoor units is described as an example. However, this configuration may be applied to an outdoor unit. That is, in a case where each of a plurality of outdoor units includes an air-sending fan, at least one (for example, all) of the plurality of outdoor units includes a refrigerant detection unit, and leakage of refrigerant is detected by the refrigerant detection unit included in any one of the plurality of outdoor units, outdoor air-sending fans included in all of the plurality of outdoor units may operate.

Furthermore, the foregoing embodiments and modifications may be implemented by combining some of them.

REFERENCE SIGNS LIST

1A, 1B, 1C, 1D, 1E, 1F indoor unit, 2, 2A, 2B outdoor unit, 3, 3A, 3B compressor, 4, 4A, 4B refrigerant flow switching unit, 5, 5A, 5B heat-source-side heat exchanger, 6, 6A, 6B, 6C, 6D, 6E, 6F pressure-reducing unit, 7A, 7B, 7C, 7D, 7E, 7F load-side heat exchanger, 8, 8A, 8B outdoor air-sending fan, 9A, 9B, 9C, 9D, 9E, 9F indoor air-sending fan, 10, 10A, 10B refrigeration cycle circuit, 11 branching unit, 20, 20A, 20B, 20C, 20D, 20E, 20F remote controller, 30 controller, 31A, 31B, 31C, 31D, 31E, 31F indoor unit control unit, 32, 32A, 32B outdoor unit control unit, 33, 33A, 33B, 33C, 33D, 33E, 33F remote controller control unit, 34 host control unit, 40A, 40B, 40C, 40D, 40E, 40F, 41A, 41B, 41C, 41D, 41E, 41F, 42, 42A, 42B, 43, 43A, 43B, 43C, 43D, 43E, 43F, 44 control substrate, 50A, 50B, 50C, 50D, 50E, 50F, 51A, 51B, 51C, 51D, 51E, 51F, 52, 52A, 52B, 53, 53A, 53B, 53C, 53D, 53E, 53F, 54 microcomputer, 99A, 99B, 99C, 99D, 99E, 99F refrigerant detection unit.

The invention claimed is:

1. A refrigeration cycle apparatus comprising:

a refrigeration cycle circuit including a plurality of load-side heat exchangers;

a plurality of indoor units accommodating the plurality of load-side heat exchangers; and a controller configured to control the plurality of indoor units, each of the plurality of indoor units including an air-sending fan, at least one of the plurality of indoor units including a refrigerant detection sensor, wherein the controller is configured such that when refrigerant is detected by the refrigerant detection sensor included in any one of the plurality of indoor units, the controller causes the air-sending fans included in all of the plurality of indoor units to operate, wherein the controller includes a plurality of indoor unit controllers configured to control the plurality of indoor units, wherein at least one of the plurality of indoor unit controllers includes a control substrate to which the refrigerant detection sensor is non-detachably connected and a nonvolatile computer memory that is provided on the control substrate, wherein the nonvolatile computer memory includes a leakage history memory region configured to store one of first information indicating that there is no refrigerant leakage history and second information indicating that there is a refrigerant leakage history, wherein the information stored in the leakage history memory region is changeable only in one direction from the first information to the second information, and wherein the controller is configured such that when refrigerant is detected by the refrigerant detection sensor included in at least one of the plurality of indoor unit controllers, the controller is configured to change the information stored in the leakage history memory region of the indoor unit controller detecting the refrigerant from the first information to the second information.

2. The refrigeration cycle apparatus of claim 1, wherein the controller is configured such that when the information stored in the leakage history memory region of at least one of the plurality of indoor unit controllers is changed from the first information to the second information, the controller causes the air-sending fans included in all of the plurality of indoor units to operate.

3. A refrigeration cycle apparatus comprising:

a plurality of refrigeration cycle circuits each including at least one load-side heat exchanger;

a plurality of indoor units accommodating the load-side heat exchangers of the plurality of refrigeration cycle circuits; and a controller configured to control the plurality of indoor units, each of the plurality of indoor units including an air-sending fan, at least one of the plurality of indoor units including a refrigerant detection sensor, wherein the controller is configured such that when refrigerant is detected by the refrigerant detection sensor included in any one of the plurality of indoor units, the controller causes the air-sending fans included in all of the plurality of indoor units to operate, wherein the controller includes a plurality of indoor unit controllers configured to control the plurality of indoor units, wherein at least one of the plurality of indoor unit controllers includes a control substrate to which the refrigerant detection sensor is non-detachably connected and a nonvolatile computer memory that is provided on the control substrate, wherein the nonvolatile computer memory includes a leakage history memory region configured to store one of first information indicating that there is no refrigerant leakage history and second information indicating that there is a refrigerant leakage history, wherein the information stored in the leakage history memory region is changeable only in one direction from the first information to the second information, and wherein the controller is configured such that when refrigerant is detected by the refrigerant detection sensor included in at least one of the plurality of indoor unit controllers, the controller is configured to change the information stored in the leakage history memory region of the indoor unit controller detects the refrigerant from the first information to the second information.

4. The refrigeration cycle apparatus of claim 3, wherein the controller is configured such that when the information stored in the leakage history memory region of at least one of the plurality of indoor unit controllers is changed from the first information to the second information, the controller causes the air-sending fans included in all of the plurality of indoor units to operate.

* * * * *